US005110716A

United States Patent [19]

Kuse et al.

[11] Patent Number: 5,110,716

[45] Date of Patent: May 5, 1992

[54] STABILIZER FOR SILVER HALIDE PHOTOGRAPHIC LIGHT-SENSITIVE MATERIAL USE AND THE METHOD OF PROCESSING THE LIGHT-SENSITIVE MATERIAL WITH THE STABILIZER

[75] Inventors: Satoru Kuse, Hino; Shigeharu Koboshi, Sagamihara; Moeko Hagiwara, Kokubunji, all of Japan

[73] Assignee: Konica Corporation, Tokyo, Japan

[21] Appl. No.: 513,221

[22] Filed: Apr. 23, 1990

[30] Foreign Application Priority Data

Apr. 28, 1989 [JP] Japan ..... 1-109956
May 26, 1989 [JP] Japan ..... 1-134357

[51] Int. Cl.[5] ..... G03C 5/39

[52] U.S. Cl. ..... 430/429; 430/372; 430/428; 430/463

[58] Field of Search ..... 430/372, 428, 429, 463

[56] References Cited

U.S. PATENT DOCUMENTS 3,645,738 2/1972 Willems et al. ..... 430/429
4,687,731 8/1987 Ishikawa et al. ..... 430/429
4,778,743 10/1988 Ishikawa et al. ..... 430/429
4,778,748 10/1988 Kuse et al. ..... 430/463
4,797,352 1/1989 Koboshi et al. ..... 430/463
4,820,623 4/1989 Koshimizu et al. ..... 430/428
4,845,015 7/1989 Kurematsu et al. ..... 430/428
4,849,333 7/1989 Fujita ..... 430/428
4,859,575 8/1989 Kurematsu et al. ..... 430/428
4,939,073 7/1990 Koboshi et al. ..... 430/428
4,963,474 10/1990 Fujita et al. ..... 430/429

FOREIGN PATENT DOCUMENTS 151538 7/1986 Japan .
27742 2/1987 Japan .
250449 10/1987 Japan .

*Primary Examiner*—Hoa Van Le
*Attorney, Agent, or Firm*—Finnegan, Henderson, Farabow, Garrett & Dunner

[57] ABSTRACT

A stabilizing solution for processing silver halide photographic light-sensitive materials and a processing method of silver halide photographic light-sensitive materials using the stabilizing solution are disclosed. The stabilizing solution contains a polyoxyalkylene type compound and a compound selected from triazine type compounds and methylol type compounds.

6 Claims, 1 Drawing Sheet

STABILIZER FOR SILVER HALIDE PHOTOGRAPHIC LIGHT-SENSITIVE MATERIAL USE AND THE METHOD OF PROCESSING THE LIGHT-SENSITIVE MATERIAL WITH THE STABILIZER

FIELD OF THE INVENTION

This invention relates to a method of processing a silver halide photographic light-sensitive material with a processing solution having a fixing function and then with a stabilizing solution but substantially without carrying out any washing treatment and, particularly, to both of a method of processing a silver halide photographic light-sensitive material and a stabilizing solution each thereby preventing the run-down troubles of the stabilizing solution and improving the safety of working environment while inhibiting the color-fading of dyes.

BACKGROUND OF THE INVENTION

Generally speaking, a photographic material is processed in the following order. After exposing it imagewise to light, it is processed in a color developing step, a bleaching step, and a processing step such as a fixing or bleach-fixing step in which a fixing capability functions and is then processed in the steps such as a stabilizing step and a washing step. In the washing step next to the processing step using the processing solution having the fixing function, a compound producing a water-soluble complex upon reaction with a silver halide, i.e., a thiosulfate, other water-soluble silver complex, and a preservative such as a sulfite and a metabisulfite, are contained in or adhere to a light-sensitive material and carried thereinto. It has been known that the amount carried in affects an image lasting quality, when a quantity of washing water is short.

For practically overcoming this disadvantage, the above-mentioned salts have been washed away from a light-sensitive material with running water in volumes. In recent years, however, for economic reasons such as a shortage of water resources and the increases of light and fuel expenses as well as for antipollution reasons, it has been demanded to economize the washing water quantity and to carry out an antipollutive processing steps.

One of the countermeasures to the above-mentioned problems is a method in which a series of water tanks is so multistaged as to flow water counterwise. This method is described in, for example, German Patent No. 2,920.22 and S. R. Goldwasser, 'Water Flow Rate in Immersion-Washing of Motionpicture Film', SMPTE, Vol.64, pp.248-253, May, 1958.

Also, there is another method having been known, wherein a preliminary washing step is provided immediately next to a fixing step so as to reduce pollutive ingredients which are carried into a regular washing bath while being contained in or adhering to a light-sensitive material, as well as a quantity of washing water required is economized.

However, the above-mentioned techniques are not applicable to any washless processes in which no washing water is used at all.

On the other hand, there are the processing methods in which, immediately after carrying out a photographic process without carrying out any washing step, a stabilizing step is followed up. Among them, there is a known silver-stabilizing process in which a thiocyanate is used, about which U.S. Pat. No. 3,335,004 for example describes. However, in these methods have a defect that stains are produced on the surface of a light-sensitive material after it was dried up, because plenty of inorganic salts are contained in the stabilizing bath. Another defect was also fount that a dye image quality is deteriorated during a long time storage.

In the meantime, when processing picture-taking color photographic light-sensitive materials including typically those containing silver iodobromide, a formalin-containing stabilizing bath is generally used in the ultimate processing step following a washing bath. It is known that the formalin contained therein is effective to prevent the variations of the physical properties of a color photographic material, such as the variations of gradation produced in the photo-graphic material either by a scratch produced on the material surface or when the material is gradually hardened by allowing it to stand, and that the formalin is also effective to prevent a dye-image stability from deterioration caused by unreacted couplers remaining in the color photographic material.

Especially in the case where formalin (or formaldehyde) is added in the stabilizing solution with the purpose of stabilizing dye images and an adduct is thereby produced with sulfite ions adhering to a light-sensitive material and being carried in from the preceding bath (such as a fixing bath)), the following disadvantages are induced. Namely, deposition of sulfur or silver sulfide in the solution is accelerated as well as decrease of effect on a dye-image stabilization that is an original requirement. To solve these problems, an application of alkanolamine has been proposed as appeared in U.S. Pat. No. 4,786,583. However, when using alkanolamine, a yellow-stain prevention has been liable to be affected in unexposed areas and prevention of the deposition of sulfur or silver sulfide has not satisfactorily been obtained.

In the U.S.A., the CIIT —Chemical Industry Institute of Toxicology— has reported that rats had the nasal cavity cancer when a formalin content was 15 ppm. NIOS —National Institute of Occupational Safety and Health, U.S.A.— and ACGIH —American Conference of Government Industrial Hygienists— each have also reported that formalin has a possibility to give rise a cancer. In Europe, on the other hand, formalin is subject to the severe restriction to use. Particularly in West Germany, it is ten years since formalin has been so restricted to use not more than 0.1 ppm inside every house.

In Japan, on the other hand, from the viewpoint that muscos membranes are irritated due to the harmfulness of formalin, the laws and regulations have been carried into effect, such as the laws concerning toxicoids and poisons, the regulations concerning organic solvent toxication of the regulations concerning specific chemical substances under the occupational safety and health administration law, the restrictions concerning household goods, the restrictions concerning fiber, textile and plywood, and the restrictions concerning the use of formalin to underwear and baby clothing, which has recently come into force since 1975 under the control of Ministry of Health and Welfare. Therefore, it has been desired so far to provide a technique capable of reducing such a formalin consumption.

Further, in recent years, it has been known that Eastman Kodak has developed the color film processing techniques so-called Processes C-41B and C-41RA each for the purposes of completing a process rapidly and saving processing baths in number. These processes comprise a series of a color developing step—a bleaching step—a fixing step—a stabilizing step—a drying step, and they may be of the rapid processing techniques in which substantially any washing step is not carried out. Not only the use of a stabilizer in the stabilizing step mentioned above, but also the use of a hexahydrotriazine compound have been known as a techniques of substituting them for formalin, as described in, for example, Japanese Patent Publication Open to Public Inspection (hereinafter referred to as Japanese Patent O.P.I. Publication) Nos. 62-27742/1987 and 61-151538/1986. However, not that even the hexahydrotriazine compounds can hardly inhibit any dyes from color-fading, but it was found that, when processing a light-sensitive material, particularly a film sample, by the use of a fixer or a bleach-fixer and, successively, a stabilizer, but not by the use of any washing water, these compounds are liable to the so-called stabilizer running-down trouble caused by an unevenness on the film sample because the stabilizer is ran-down over the rear side of the film sample. Especially when an amount of the stabilizer replenished is short, this trouble becomes more serious than negligible.

SUMMARY OF THE INVENTION

After the inventors have studied diversely, they have discovered the following facts: the application of a triazine type compound or a methylol type compound makes it possible to stabilize a dye-image and to inhibit stains, without using any formalin, because of the effect obtained by the suppositive reason that a small amount of formalin is released from a drying step, or a gelatin layer is hardened; at the same time, deposition of sulfur or silver sulfide in stabilizer can remarkably be inhibited because no formalin is used; further, the running-down unevenness and stains on the surface of a film base, which are the defects caused by using the triazine type compound or methylol type compound, can be removed by the combination use of these compound and a polyoxyalkylene type surface active agent so that the wettability of the rear surface of the film can be improved; and the above-mentioned trouble can be solved without diminishing the effects of triazine. From the above-mentioned discoveries, this invention has been achieved. The polyoxyalkylene type surface active agent makes the surface tension of a stabilizer lower down to 20 to 50 dyne/cm and makes the rear surface of a film, that is the base surface of the film, hydrophilic. At the same time, it may be conjectured that the effects of the invention may be displayed by either that the solubility of the triazine type compound or methylol type compound of the invention to a stabilizer may not be deteriorated, or that, in some instances, the solubility thereof may be increased.

In addition to the above, upon studying later on, it was further found that, when such a polyoxyalkylene type surface active agent is used, a processed film itself is also provided with a property that any dust can hardly adhere to the film. It was still further found that the above-mentioned property is induced by being provided with an antistatic function.

It is an object of the invention to provide an improvement of a stabilizer running-down trouble while inhibiting a dye from color-fading.

Another object of the invention is to reduce the use of formalin or not to use it so as to improve the safety of the working environment at a photofinishing laboratory.

A further object of the invention is to improve an antistatic property of the finished photographic light-sensitive material.

A still further object of the invention is not to substantially use washing water, but to realize a resources saving and energy saving.

The above-mentioned objects of the invention is achieved by a stabilizing solution comprising a compound having a polyalkylene group; and a compound having a triazine ring or a compound having a methylol group, (hereinafter these compounds refer to polyalkylene type compound, triazine type compound and methylol type compound, respectively) and a method for processing a silver halide photographic light-sensitive material using the stabilizing solution. In this processing, the photographic material is treated by the stabilizing solution after a treatment with a solution which have a function of fixing a silver halide photographic material. Any step for washing the photographic material is not provided between the treatment with the solution having the fixing ability and the treatment with the stabilizing solution of the invention. Hereinafter, the stabilizing solution refer to stabilizer.

DETAILED DESCRIPTION OF THE INVENTION

Figure 1:
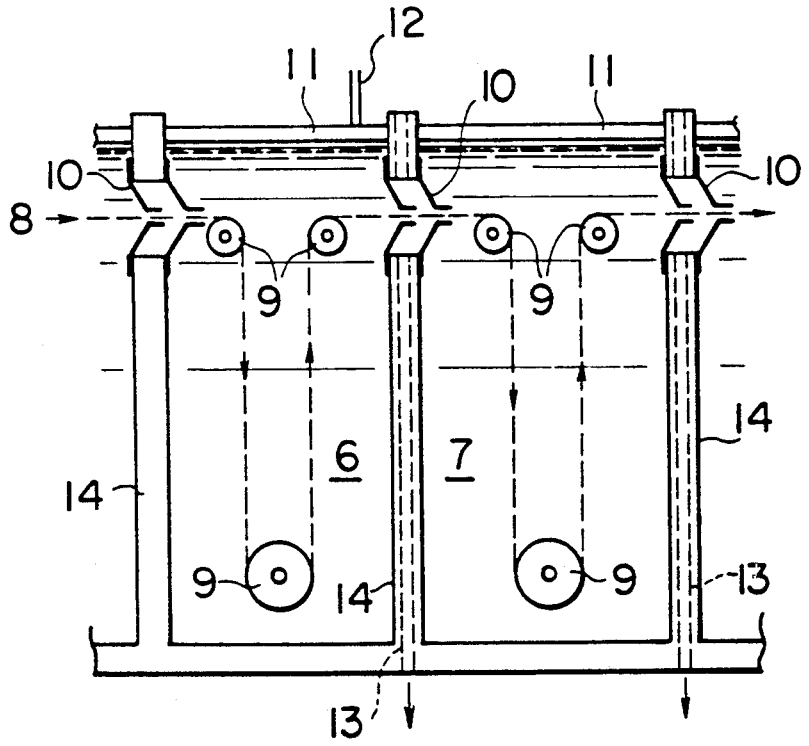
FIG. 1 is a cross-sectional view illustrating fixing or bleach-fixing tank 6 and a stabilizing tank 7, each of which is a portion of an automatic processor used in Example 11. In the figure, referential numeral 8 is a path for a light-sensitive material, 9 is a conveying roller, 10 is a duckhill valve for squeezing and sealing a solution, 12 is an inlet tube for a replenisher, 13 is an outlet tube for carried solution, and 14 is a partition wall.

Polyalkylene type compounds used in the invention mean water-soluble compounds each having at least a polyalkylene group in the molecular structure thereof. They include, for example, polyethylene glycol, triethylene glycol and diethylene glycol. In the invention, water-soluble siloxane type compounds each having a polyoxyalkylene group and the compounds represented by the following Formula I or II may preferably be used.

Formula I $$A_2—O—(A)l—(B)m—(C)n—X_1$$

In the formula, $A_2$ represents a monovalent organic group including, for example, an alkyl group having 6 to 50 carbon atoms and preferably 6 to 35 carbon atoms, such as those of hexyl, heptyl, octyl, nonyl, decyl, undecyl or dodecyl, or an aryl group substituted with an alkyl group having 3 to 35 carbon atoms or an alkenyl group having 2 to 35 carbon atoms.

For the groups preferably substituted onto the aryl groups, alkyl groups each having 1 to 18 carbon atoms including, for example, non-substituted alkyl groups such as those of methyl, propyl, butyl, pentyl, hexyl, heptyl, octyl, nonyl, decyl, undecyl or dodecyl and substituted alkyl groups such as those of benzyl or phenethyl, or alkenyl groups each having 2 to 20 carbon atoms including, for example, non-substituted alkenyl groups such as those of oleyl, cetyl or allyl and substituted alkenyl groups such as a styryl group, may be given as the examples thereof. The aryl groups include, for example, a phenyl, biphenyl or naphthyl group. Among them a phenyl group is preferable. These groups may be substituted to an aryl group at any one of the ortho, meta and para positions of the aryl group. A plurality of groups may be substituted.

A, B or C represents an ethyleneoxy, propyleneoxy, or a $$-(CH_2)_{n1}-(\underset{\underset{OH}{|}}{CH})_{m1}-(CH_2)_{l1}-O- \text{ group,}$$

$m_1$ is an integer of 1, 2 or 3, and provided, $n_1$, and $l_1$ are each an integer of 0, 1, 2 or 3.

l, m and n is an integer of 0 to 100, provided that the total of m and n is not less than 2.

$X_1$ represents a hydrogen atom or an alkyl, aralkyl or aryl group, the groups described in the case of $A_2$ may be given as the example of $X_1$.

Formula II $$R_1\ X_2(E^1)_{l2}(E^2)_{m2}(E^3)_{n2}R^2$$

In the formula, $R^1$ represents a hydrogen atom, an aliphatic or an acyl group, and $R^2$ represents a hydrogen atom or an aliphatic group.

$E^1$, $E^2$ and $E^3$ represent each an ethyleneoxy or propyleneoxy group, $X_2$ represents an oxygen atom or an $$-\overset{\overset{R_3}{|}}{N}- \text{ group}$$

in which $R^3$ represents an aliphatic group, a hydrogen atom or an $-(E^1)_{l3}(E^2)_{m3}(E^3)_{n3}\ R^4$ group in which $R^4$ represents a hydrogen atom or an aliphatic group.

$l_2$, $l_3$, $m_2$, $m_3$, $n_2$ and $n_3$ are each an integer of 0 to 200, and total of $l_2$, $m_2$ and $n_2$, and that of $l_3$, $m_3$ and $n_3$ are eche nol less than 2.

Typical exemplified compounds represented by formula I will be given below.

$C_{12}H_{25}O(C_2H_4O)_{10}H$ I-1

$C_8H_{17}O(C_3H_6O)_{15}H$ I-2

$C_9H_{19}O(C_2H_4O)_4SO_3Na$ I-3

$C_{10}H_{21}O(C_2H_4O)_{15}PO_3Na_2$ I-4

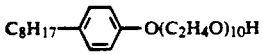

I-5

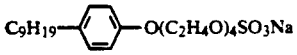

I-6

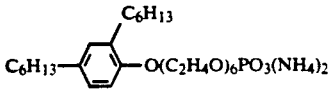

I-7

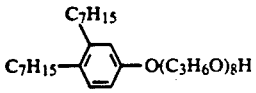

I-8

-continued

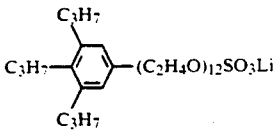

I-9

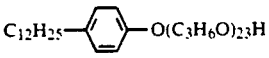

I-10

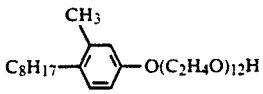

I-11

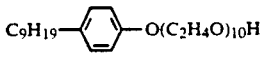

I-12

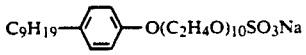

I-13

$C_{12}H_{25}-O(C_2H_4O)_{12}-H$ I-14

$C_9H_{19}-O(C_2H_4O)_4H$ I-15

$C_{10}H_{21}-O(C_2H_4O)_{15}-H$ I-16

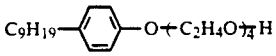

I-17

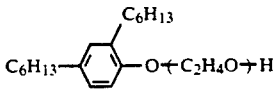

I-18

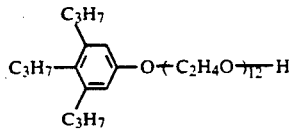

I-19

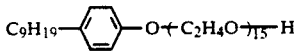

I-20

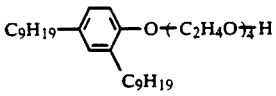

I-21

$C_{12}H_{25}O(C_2H_4O)_4H$ I-22

$C_6H_{13}-O(C_2H_4O)_{10}-H$ I-23

$C_8H_{17}-O(C_2H_4O)_{15}-H$ I-24

$C_{10}H_{21}-O(C_2H_4O)_{10}-H$ I-25

$C_{12}H_{25}-O(C_2H_4O)_{15}-H$ I-26

$C_{14}H_{29}-O(C_2H_4O)_{15}-H$ I-27

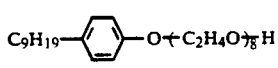

I-28

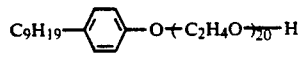

I-29

-continued

I-30

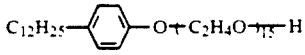

I-31

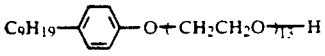

I-32

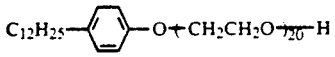

I-33

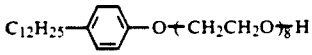

I-34

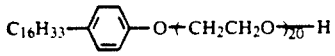

I-35

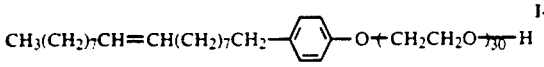

I-36

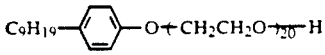

I-37

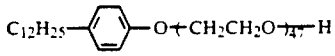

I-38

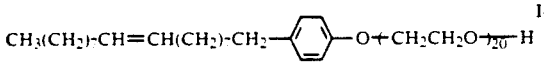

I-39

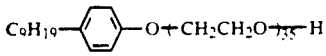

I-40

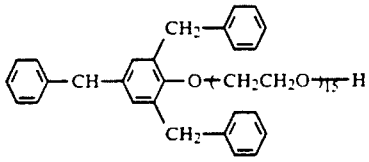

I-41

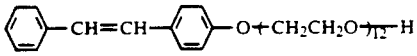

I-42

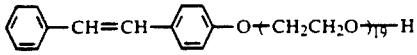

I-43

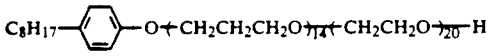

I-44

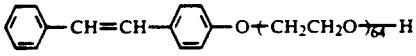

I-45

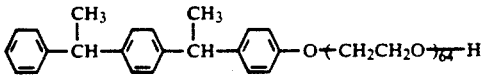

I-46

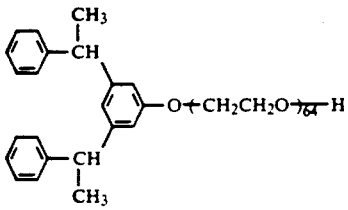

-continued

I-47

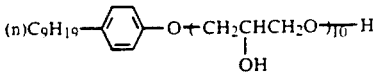

I-48

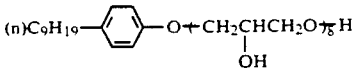

I-49

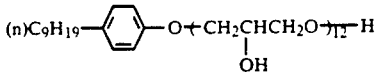

I-50

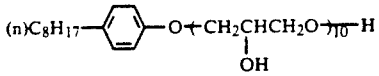

I-51

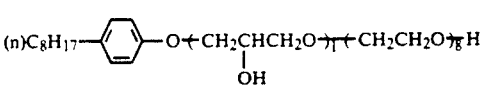

I-52

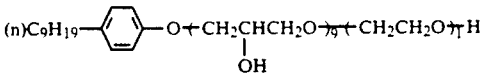

I-53

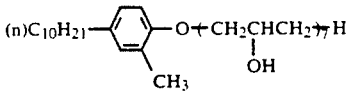

I-54

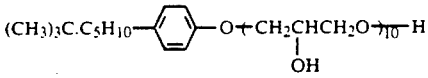

I-55

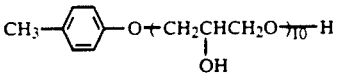

I-56

$(n)C_{13}H_{27}-O\leftarrow CH_2CH_2O\rightarrow_5H$

I-57

$C_{12}H_{25}-O\leftarrow CH_2CH_2O\rightarrow_{10}H$

I-58

$C_{18}H_{37}-O\leftarrow CH_2CH_2O\rightarrow_{10}H$

I-59

$(n)C_{10}H_{21}-O\leftarrow CH_2CH_2O\rightarrow_4H$

I-60

$(n)C_{16}H_{33}-O\leftarrow CH_2CH_2O\rightarrow_4H$

I-61

$(n)C_{12}H_{25}-O\leftarrow CH_2CH(OH)CH_2O\rightarrow_{10}H$

I-62

$(n)C_{12}H_{25}-O\leftarrow CH_2CH(OH)CH_2O\rightarrow_2\leftarrow CH_2CH_2O\rightarrow_8H$

I-63

$(n)C_{13}H_{27}-O\leftarrow CH_2CH_2O\rightarrow_4H$

I-64

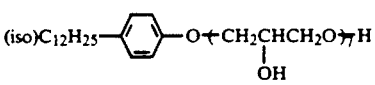

I-65

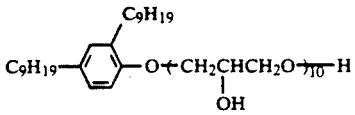

-continued
I-66
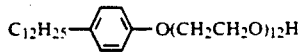
I-67
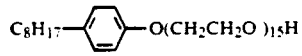
I-68
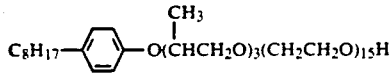
I-69
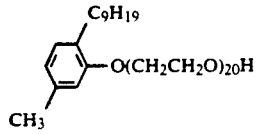
I-70
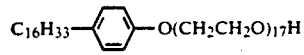
I-71
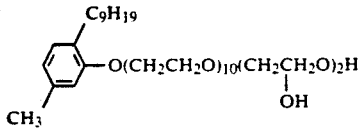
I-72
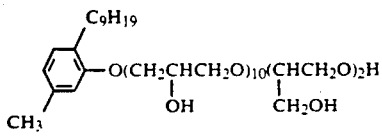
I-73
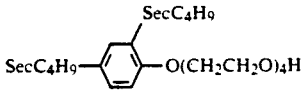
I-74
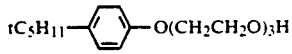
I-75
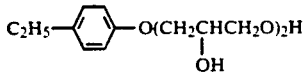
I-76
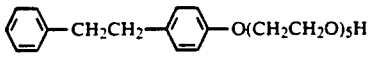
I-77
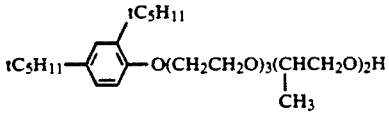
I-78
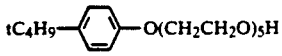
I-79
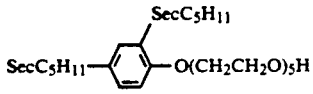
I-80
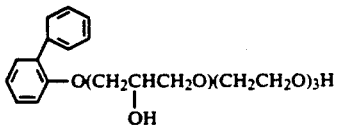
-continued
I-81
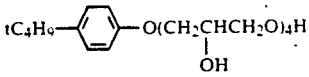
I-82
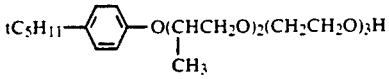
I-83
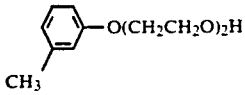
I-84
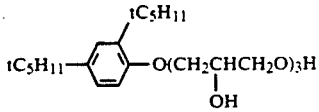
I-85
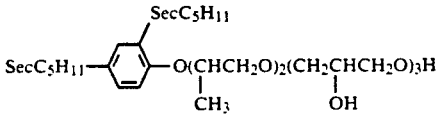
I-86
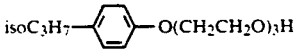
I-87
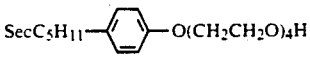
I-88
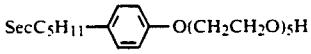
(Compounds represented by Formula II)
II-1 $C_{12}H_{25}COO(C_2H_4O)_{10}H$
II-2 $C_9H_{19}COO(C_2H_4O)_{14}H$
II-3 $C_{12}H_{25}NH(C_2H_4O)_{10}H$
II-4 $C_{12}H_{25}NH(C_2H_4O)_{15}H$
II-5 $HO(C_2H_4O)_{20}(CH(CH_3)CH_2O)_{5}(C_2H_4O)_{20}H$
II-6 $C_{12}H_{25}-NHCH_2CH_2OH$
II-7 $C_{12}H_{25}-N(CH_2CH_2O)_{10}H)(CH_2CH_2O)_{10}H)$
II-8 $C_{12}H_{25}-N(CH_2CH_2O)_{15}H)(CH_2CH_2O)_{15}H)$
II-9 $HO(CH_2CH_2CH_2O)_{28}(CH_2CH_2O)_{145}H$
II-10 $HO(CH_2CH_2CH_2O)_{28}(CH_2CH(OH)CH_2O)_{60}H$
II-11 $HO(CH(CH_3)CH_2O)_{20}(CH_2CH_2O)_{150}H$ -continued $$H(OCH_2CH_2)_{70}(OCH_2CH_2CH_2)_{30}(OCH_2CH_2)_{70}OH \quad \text{II-12}$$

The compounds represented by Formula I or II may be used in an amount of 0.05~40 g and preferably 0.1~20 g per liter of a stabilizer of the invention used.

Among the water-soluble organic siloxane type compounds each having a polyoxyalkylene group (hereinafter simply referred to as water-soluble organic siloxane type compounds), the compounds each represented by the following formula VII may preferably be used.

Formula VII

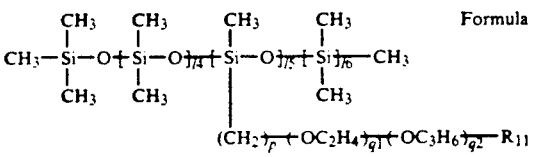

wherein $R_9$ represents a hydrogen atom, or a hydroxy, lower alkyl, alkoxy,

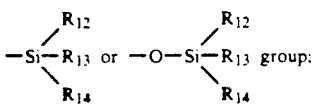

$R_{12}$, $R_{13}$ and $R_{14}$ each represent a lower alkyl group including, preferably, an alkyl group having 1 to 3 carbon atoms, such as a methyl, ethyl or propyl group, provided, $R_{12}$, $R_{13}$ and $R_{14}$ may be the same with or the different from each other; $l_4$ to $l_6$ are each 0 or an integer of 1 to 4 provided that the total of $l_4$, $l_5$ and $l_6$ is nol less than 2; and p, $q_1$and $q_2$ are each an integer of 1 to 15.

Some typical examples of the compounds represented by Formula VII will be given below.

VII-1

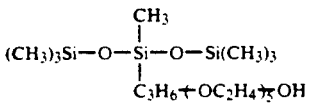

VII-2

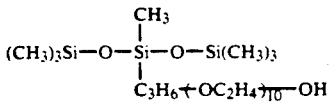

VII-3

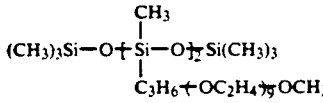

VII-4

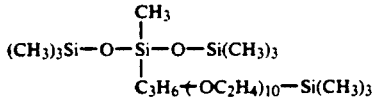

VII-5

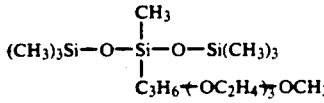

VII-6

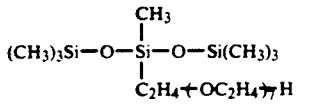

-continued

VII-7

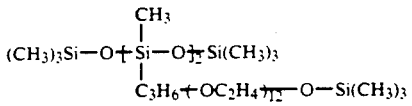

VII-8

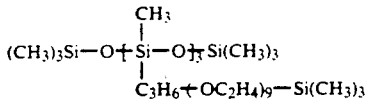

VII-9

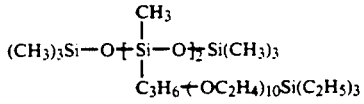

VII-10

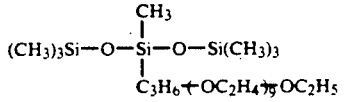

VII-11

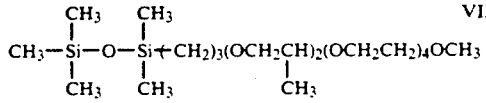

VII-12

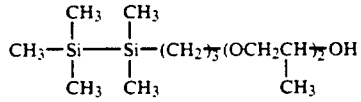

VII-13

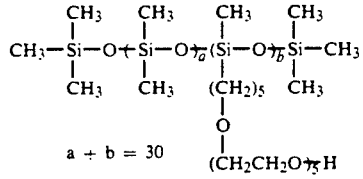

a + b = 30

VII-14

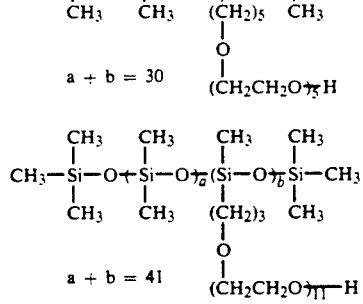

a + b = 41

VII-15

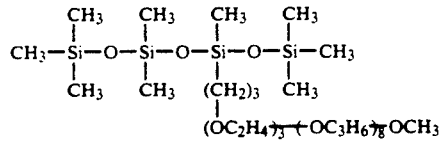

An excellent effect can be displayed when adding the above-given water-soluble organic siloxane type compound having a polyoxyalkylene group in an amount within the range of 0.01 to 20 g per liter of a stabilizer used.

If using it in an amount of less than 0.01 g, the surface of a light-sensitive material will be markedly stained and, on the other hand, if using it in an amount of more than 20 g, a large amount of organic siloxane compounds will adhere to the surface of the light-sensitive material and, as the result, the staining are rapidly produced.

The water-soluble organic siloxane type compounds of the invention herein mean common water-soluble organic siloxane type compounds such as those described in, for example, Japanese Patent O.P.I. Publication Nos. 47-18333/1972 and 49-62128/1974, Japanese Patent Examined Publication Nos. 55-51172/1980 and 51-37538/1976, and U.S. Pat. No. 3,545,970.

These kinds of water-soluble organic siloxane type compounds are popularly available from UCC —Union Carbide Company—, Shinetsu Chemical Industries Company and so on.

At least one kind of the polyoxyalkylene type compounds applicable to the invention should be added. It is, however, allowed to add them in combination and to use together with a known surfactant.

Next, triazine type compounds application to the invention will be detailed below. Triazine type compounds preferably used in the invention are those represented by the following formula III:

Formula III

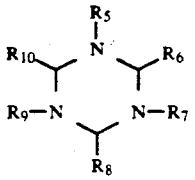

wherein $R_5$ to $R_{10}$ represent each a hydrogen atom or a monovalent organic group. Such monovalent organic groups include, for example, an alkyl, aryl, alkenyl, alkinyl, aralkyl, amino, alkoxy, hydroxyl, acyl, sulfonyl, alkylthio, arylthio, heterocyclic group, carbamoyl, sulfamoyl group and alkylamino group.

The above-given monovalent organic groups each may have a substituent including, for example, a hydroxyl, acyl, sulfonyl, amino, or carboxyl group or a halogen atom and, preferably, a hydroxyl group or a halogen atom. The substituents represented by any one of $R_5$ to $R_{10}$ each preferably have not more than 10 carbon atoms in total.

The group consisting of $R_5$, $R_7$ and $R_9$ and the group consisting of $R_6$, $R_8$ and $R_{10}$ may be the same with or the different from each other. It is, however, preferable when either one group consists of hydrogen atoms, every one of them.

Some typically exemplified triazine type compounds applicable to the invention will be given below.

III-1

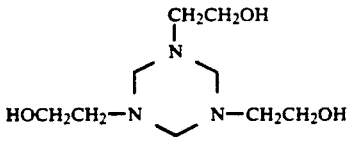

III-2

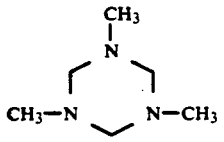

III-3

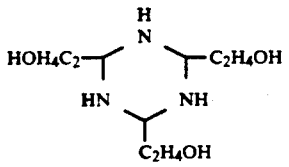

-continued

III-4

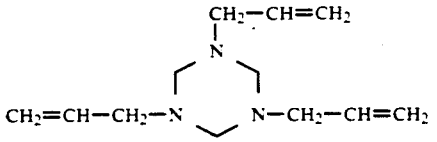

III-5

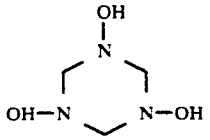

III-6

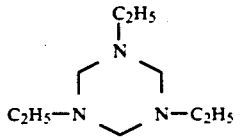

III-7

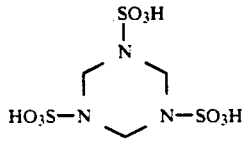

III-8

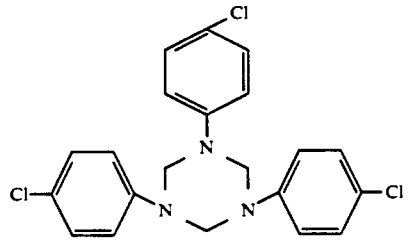

III-9

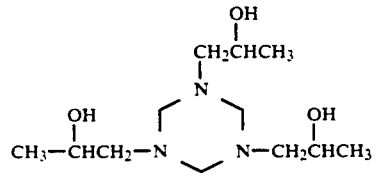

III-10

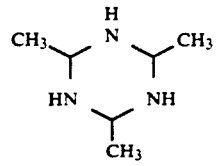

III-11

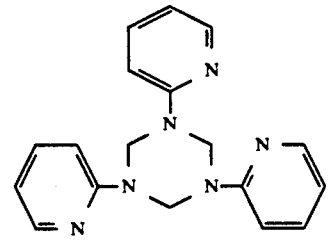

III-12

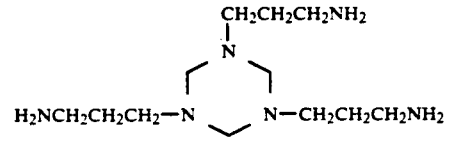

-continued

III-13

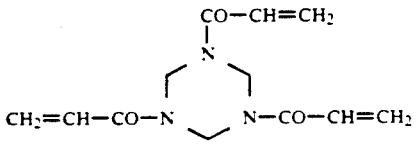

III-14

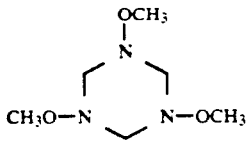

III-15

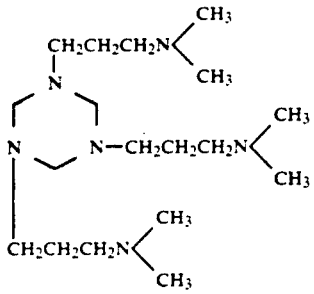

III-16

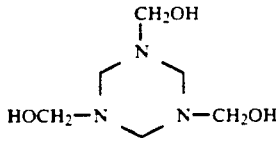

The above-given triazine type compounds each can be used in an amount within the range of 0.05 to 50 g and, more preferably, 0.1 to 20 g, per liter of a stabilizer used.

The methylol type compounds preferably applicable to the invention are those represented by the following formulas IV, V or VI:

Formula IV

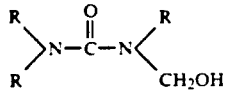

Formula V

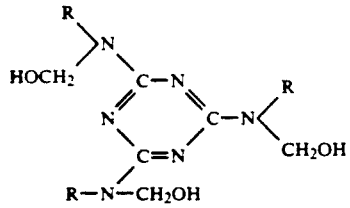

Formula VI

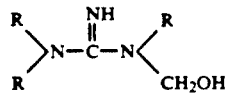

in the formulas, R is a hydrogen tom or a methylol group.

The methylol type compounds represented by Formula IV, V or VI include, for example, the following compounds:

Dimethylol urea,
Trimethylol urea,
Dimethylol guanidine,
Trimethylol melamine,
Tetramethylol melamine,
Pentamethylol melamine, and
Hexamethylol melamine These compounds may be added in an amount within the range of 0.5 ~ 20 g and preferably 0.1 ~ 10 g per liter of a stabilizer used. When they are added in an amount within the above-given range, the advantages of the invention may be displayed effectively.

The stabilizers of the invention may be used for a stabilizer applicable to a stabilizing step following a washing step, that is the ultimate processing step for a silver halide color photographic light-sensitive material. However, the stabilizing solutions of the invention can display the effects and advantages utmost especially in the case of the invention, where the silver halide color photographic light-sensitive material is treated with a processing solution having a fixing function, such as a fixer or a bleach-fixer, and is successively treated in a stabilizing step without substantially washing the light-sensitive material. There is no special limitation to the silver halide color photographic light-sensitive materials to be processed, but they include, for example, a negative film, a print paper, and a color-copy paper. They can be processed with the stabilizers of the invention, Among the light-sensitive materials, a transparent type light-sensitive material is preferably used to meet the objects of the invention.

The stabilizer of the invention is preferably replenished in an amount 1 to 18 times as much as the amount carried in from the preceding bath, per a unit area of a color photographic light-sensitive material for photographing use. In the invention, however, the ingredients of the preceding bath that is a bleach-fixer or a fixer carried into a washless stabilizer has a concentration of not more than 1/100 and, preferably, not more than 1/500 in the last tank of stabilizer tanks. From the aspects for making pollution lower and keeping a solution longer, the stabilizing tanks and the replenishing amount of stabilizer are to be so constituted as to have a concentration of 1/100 to 1/100000 and, preferably, 1/500 to 1,50000.

It is permitted that such stabilizing tank is composed of a plurality of tanks. In the invention, it is preferable that the stabilizing tank is composed of 2 to 6 tanks.

In the case of not less than 2 tanks in the invention, a counter-current system that is a system of supplying the stabilizing solution into the following bath and overflowing the solution to the preceding bath is particularly preferable to be used form the viewpoints of displaying the effects of the invention and improving pollution problems and image preservability.

An amount of the solution of preceding tank carried in the stabilizing tank depends on the kinds of light-sensitive materials, the speeds of transporting a light-sensitive material in an automatic processor, the transport system, the systems of squeezing the surface of a light-sensitive material, and so forth. In the case of a color light-sensitive material for photographing use, however, an amount carried in is normally within the range of 50 ml/m$^2$ to 150 ml/m$^2$, and an amount replenished, which is distinctly effective for the invention, is within the range of 500 ml/m$^2$ to 4.0 liter/m$^2$ to the above-mentioned amount carried in. In particular, a markedly effective amount replenished is within the range of 600 ml/m$^2$ to 1500 ml/m$^2$.

A processing temperature for the stabilizing step is within the range of 15° to 60° C. and, preferably, 20° to 45° C.

It is preferred to contain a chelating agent represented by any one of the following formulas VIII through X into the stabilizer of the invention.

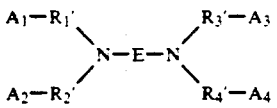

Formula VIII wherein E represents an alkylene, cycloalkylene, phenylene, $-R_5'-O-R_5'-$, $-R_5'-O-R_5'-O-R_5'-$, or $-R_5'-Z-R_5'-$; group

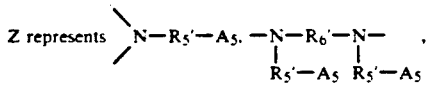

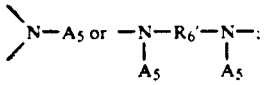

$R_1'$ to $R_6'$ represent each an alkylene group; $A_1$ to $A_3$ represent each —COOM or $-PO_3M_2$; $A_4$ and $A_5$ represent each a hydrogen atom, a hydroxyl group, —COOM or $-PO_3M_2$; and M represents a hydrogen atom or an alkali metal atom.

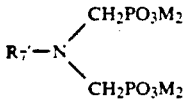

Formula IX wherein $R_7'$ represents an alkyl, aryl or nitrogen-containing six-membered-ring group; and M represents a hydrogen atom or an alkali metal atom.

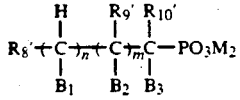

Formula X wherein $R_{98}'$, $R_9'$ and $R_{10}'$ each represent a hydrogen atom, a hydroxyl group, —COOM, $-PO_3M_2$ or an alkyl group; $B_1$, $B_2$ and $B_3$ represent each a hydrogen atom, a hydroxyl group; —COOM, $-PO_3M_2$ or

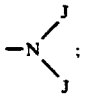

J represents a hydrogen atom, an alkyl group, $-C_2H_4OH$ or $-PO_3M_2$; M represents a hydrogen atom or an alkali metal atom; and n and m are each 0 or 1.

Some of the typical examples of the chelating agents represented by Formulas VIII, IX and X will be given below. It is, however, to be understood that the chelating agents applicable to the invention shall not be limited to those given below.

[Exemplified chelating agents]

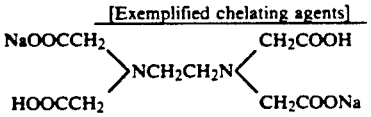

(1)

-continued

[Exemplified chelating agents]

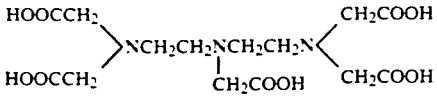

(2)

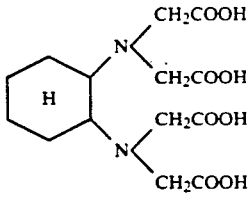

(3)

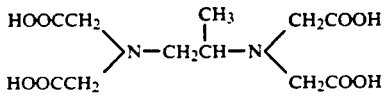

(4)

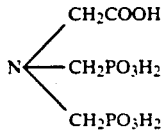

(5)

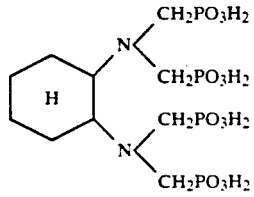

(6)

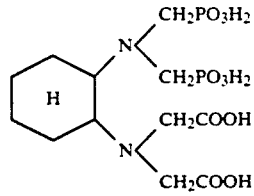

(7)

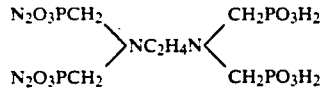

(8)

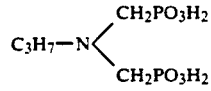

(9)

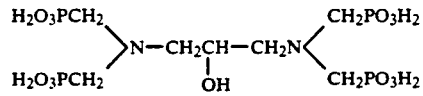

(10)

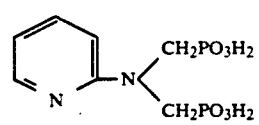

(11)

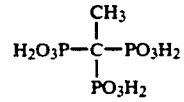

(12)

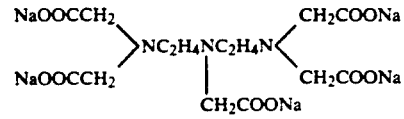

(13)

-continued
[Exemplified chelating agents]
(14)
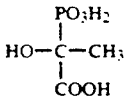
(15)
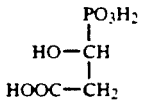
(16)
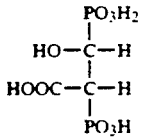
(17)
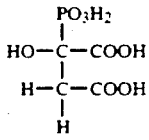
(18)
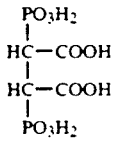
(19)
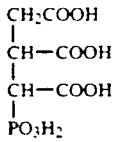
(20)
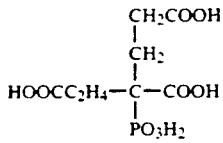
(21)
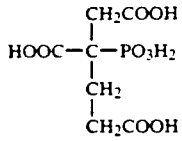
(22)
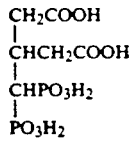
(23)
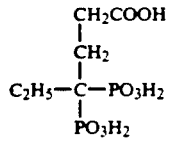
(24)
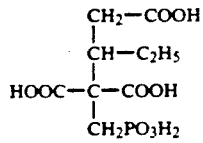
-continued
[Exemplified chelating agents]
(25)
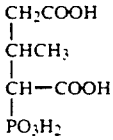
(26)
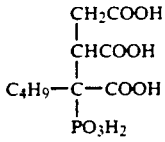
(27)
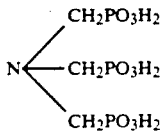
(28)
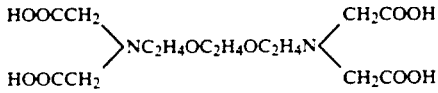
(29)
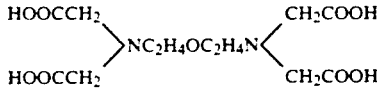
(30)
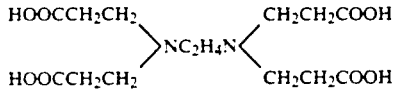
(31)
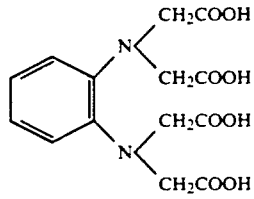
(32)
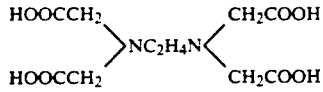
(33)
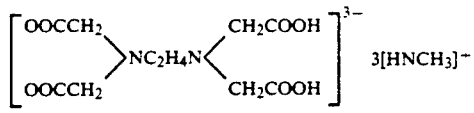
(34)
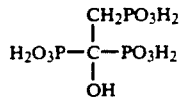
(35)
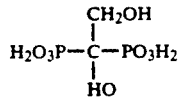
(36)
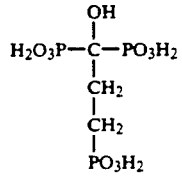

-continued

[Exemplified chelating agents]

(37)

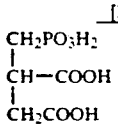

(38)

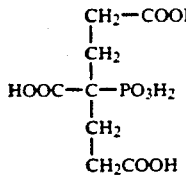

(39)

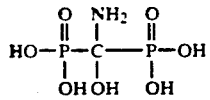

(40)

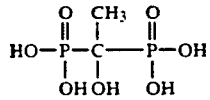

(41)

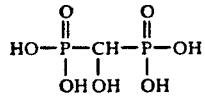

(42)

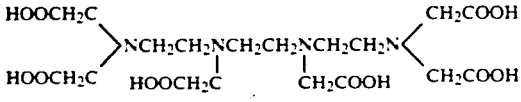

The chelating agents preferably applicable to the invention are used in an amount within the range of, preferably, 0.01 to 100 g, more preferably, 0.05 to 50 g and, particularly, 0.1 to 20 g, per liter of a stabilizing solution of the invention used therein.

For the purpose of improving the image preservability that is an object of the invention, the washless stabilizing of the invention are to have a pH value within the range of, preferably, pH 3.0 to 9.0, more preferably pH 4.0 to 9.0.

The pH controlling agents permitted to be contained in the stabilizer of the invention include, for example, commonly known alkalifiers or acidifiers.

The stabilizers of the invention can contain organic acid salts such as those of citric acid, acetic acid, succinic acid, oxalic acid and benzoic acid, pH controlling agents such as a phosphate, borate, hydrochloric acid and a sulfate, surfactants, antiseptics, and metal salts such as those of Bi, Mg, Zn, Ni, Al, Sn, Ti and Zr. It causes no difficulty even if adding the above-given compounds in any combination, provided, the compound is to be added in an amount within the limit that the pH of the stabilizer of the invention can necessarily be maintained and both of the stability and precipitation formation in preserving color photographic images cannot be affected.

The antimolds preferably applicable to the stabilizers of the invention include, for example, a hydroxybenzoic acid ester compound, a phenol type compound, a thiazole type compound, a pyridine type compound, a guanidine type compound, a carbamate type compound, a morpholine type compound, a quaternary phosphonium type compound, an ammonium type compound, a urea type compound, an isoxazole type compound, a propanolamine type compound, a sulfamide type compound, an amino acid type compound and a benztriazole type compound.

From the viewpoint of solution preservability, the phenol, thiazole and benztriazole types of the compounds are particularly preferable.

The typical examples thereof include, for example, 1,2-benzisothiazoline-3-one, 2-methyl-4-isothiazoline-3-one, 2-octyl-4-isothiazoline-3-one, 5-chloro-2-methyl-4-iso-thiazoline-3-one, sodium o-phenylphenolate, and benztriazole. The addition of any one of these antimolds to a stabilizer is in an amount within the range of, preferably, 0.001 g to 20 g and, more preferably, 0.005 g to 10 g.

For the purpose of stabilizing dyes, the stabilizers of the invention can be used in combination with formalin, hexamethylenetetramine, and aliphatic aldehyde, as described in U.S. Pat. No. 4,786,583.

For embodying the invention, a preferable mode is to make formalin substantially free and, as described above, formalin can be made substantially free by making use of a triazine type compound and/or a methylol compound, which are the compounds of the invention.

The expression, substantially freed formalin, stated herein means that formalin in the form of a 35% solution is in an amount of not more than 1.0 ml, preferably not more than 0.5 ml and more preferably zero, per liter of a stabilizer used.

It is also preferable for the invention to embody that hexamethylenetetramine is used in combination therewith. When making formalin substantially free, an excellent result can be obtained in photographic characteristics and, particularly, the embodiment is effective to prevent yellow stains and dark keeping dye stability. The typical compounds which are used in an amount within the range of 0.05 to 10 g and preferably 0.1 to 5.0 g per liter of a stabilizer used are described in, for example, Japanese Patent O.P.I. Publication Nos. 63-244036/1988 and 63-266452/1988.

The stabilizing solutions of the invention are preferable to contain, besides the compounds of the invention, a sulfite ion releasable compound and at least one of the compounds represented by the following formulas A and B. When this is the case, a solution preservability can remarkably be improved without affecting any one of the advantages and photographic characteristics of the invention.

Formula A

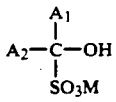

Formula B

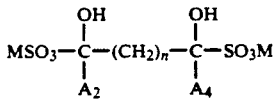

wherein $A_1$, $A_2$, $A_3$ and $A_4$ represent each a hydrogen atom, an alkyl group having 1 to 6 carbon atoms, a formyl, acyl or alkenyl group; M represents an alkali metal atom such as that of Na, K or Li; and n is an integer of 1 to 5. The alkyl groups each having 1 to 6 carbon atoms include, for example, those each having a straight or branched chain, such as a methyl, ethyl, n-propyl, isopropyl, n-butyl, hexyl or isohexyl group, and they may be substituted with. Such substituents include, for example, formyl groups such as a formylmethyl or 2-formylethyl group, amino groups such as an aminomethyl or aminoethyl group, hydroxyl groups such as a hydroxymethyl, 2-hydroxyethyl or 2-hydroxy-propyl group, alkoxy groups such as a methoxy or ethoxy group, and substituents containing a halogen atom, such as a chlormethyl, trichloromethyl or dibromomethyl group.

The alkenyl groups include those substituted or unsubstituted. The unsubstituted alkenyl groups include, for example, a vinyl or 2-propenyl group. The substituted alkenyl groups include, for example, a 1,2-dichloro-2-carboxyvinyl or 2-phenylvinyl group.

Some typical compounds represented by the above-given formulas A and B will be exemplified below. It is, however, to be understood that the invention shall not be limited thereto.

Exemplified compounds

A-1 Adduct of sodium bisulfite and formaldehyde
A-2 Adduct of sodium bisulfite and acetoaldehyde
A-3 Adduct of sodium bisulfite and propionaldehyde
A-4 Adduct of sodium bisulfite and butylaldehyde
B-1 Adduct of sodium bisulfite and succinaldehyde
B-2 Adduct of sodium bisbisulfite and glutaraldehyde
B-3 Adduct of sodium bisbisulfite and $\beta$-methylglutaraldehyde
B-4 Adduct of sodium bisbisulfite and maleicdialdehyde The above-given compounds represented by Formulas A and B may be used independently or in combination. The compounds are each added, to a stabilizing solution of the invention, in an amount within the range of, preferably, 0.1 to 50 g and, more preferably, 0.1 to 20 g, per 1 liter of the stabilizer.

The sulfite ion releasable compounds applicable to the invention may be each of organic and inorganic substances, provided, they are able to release sulfite ions. However, the inorganic substances are preferable. Such preferable compounds include, typically, the following compounds:

C-1 Sodium silfite
C-2 Potassium sulfite
C-3 Ammonium sulfite
C-4 Ammonium bisulfite
C-5 Potassium bisulfite
C-6 Sodium bisulfite
C-7 Sodium metabisulfite
C-8 Potassium metabisulfite
C-9 Ammonium metabisulfite
C-10 Hydrosulfite Each of these compounds is added in an amount within the range of, preferably, 0.01 to 0.1 mol per liter and, more preferably, 0.02 to 0.1 mol per liter of stabilizer of the invention.

In the invention, the processing solution having a fixing function means a fixer or a bleach-fixer. It is the matter of course that such fixers also include stop-fixers and hardening fixers.

In the process of the invention, a silver recovery may be made from a stabilizer. The stabilizer may also be subjected to an ion-exchange treatment, an electrodialysis treatment of which is described in Japanese Patent O.P.I. Publication No. 61-28949/1986, a reverse osmosis treatment of which is described the same in Japanese Patent Publication /1984. It is also preferable to use water deionized in advance before used in a stabilizer. This is because the antimold property and stability each of a stabilizer and an image preservability can be improved. Any deionization methods may be used, provided that the Ca or Mg ion contents of posttreated rinsing water may be reduced to not more than 5 ppm. It is however preferable that the treatments each using an ion-exchange resin or a reverse osmosis membrane are used independently or in combination. Technical report open to the public No. 87-1984 describes about the ion-exchange resins and the reverse osmosis membranes.

In the processing relating to the invention, the bleaching agents applicable to the bleaching solutions include, for example, the ferric complex salts of organic acids represented by Formula A-I or B-I, and the ferric complex salts of the exemplified compounds represented by A'-1 ~16 and so forth. Among them, the ferric complex salts of organic acids represented by Formula A-I or B-I are preferable.

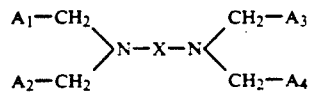

Formula A-I wherein $A_1 \sim A_4$ may be the same with or the different from each other and represent each —$CH_2OH$, —COOM or —$PO_3M^1M^2$, M, $M^1$ and $M^2$ represent each a hydrogen atom, an alkali metal or ammonium, and X represents a substituted or unsubstituted alkylene group having 3~6 carbon atoms.

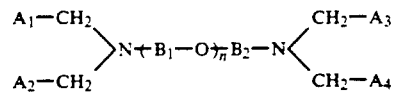

Formula B-I wherein $A_1 \sim A_4$ are each synonymous with those defined in the above-given formula A-I, n is an integer of 1~8, and $B_1$ and $B_2$ may be the same with or the different from each other and represent each a substituted or unsubstituted alkylene group having 2~5 carbon atoms.

Now, the compounds represented by Formula A-I will be detailed below.

$A_1 \sim A_4$ may be the same with or the different from each other and represent each —$CH_2OH$, —COOM or —$PO_3M^1M^2$ in which M, $M^1$ and $M^2$ represent each a hydrogen atom, an alkali metal such as sodium and potassium or ammonium, X represents a substituted or unsubstituted alkylene group having 3~6 carbon atoms, such as those of propylene, butylene, pentamethylene. Such substituents include, for example, hydroxyl groups and alkyl groups each having 1~3 carbon atoms.

Some preferable examples of the compounds represented by the above-given Formula A-I will be given below.

A-1

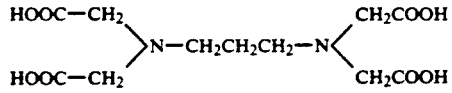

A-2

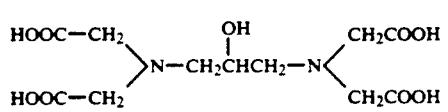

-continued

A-3

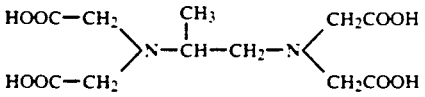

A-4

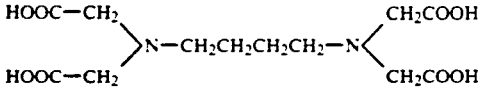

A-5

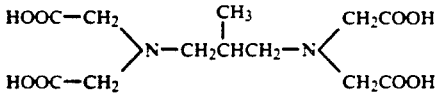

A-6

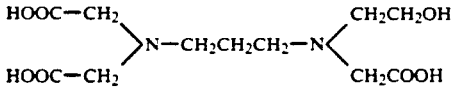

A-7

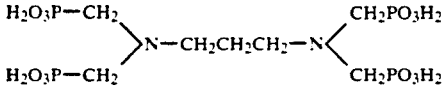

A-8

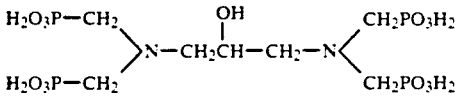

A-9

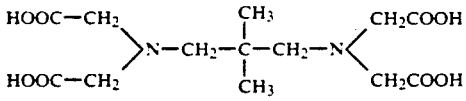

-continued

A-10

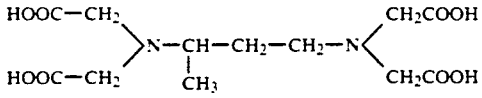

A-11

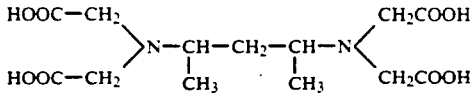

A-12

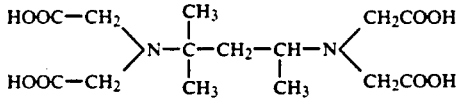

For the ferric complex salts of the compounds A-1 ~ A-12, any one of ferric sodium, potassium or ammonium complex salts may be used.

Among these examples of the compounds, those preferably used in the invention include, A-1, A-3, A-4, A-5 and A-9 and, those more preferably used therein include, for example, A-1.

Now, the compounds represented by Formula B-I will be detailed below.

$A_1 \sim A_4$ are synonymous with the those denoted above, n is an integer of 1 ~ 8, and $B_1$ and $B_2$ may be the same with or the different from each other and include, for example, substituted or unsubstituted alkylene group having 2 ~ 5 carbon atoms, such as those of ethylene, propylene, butylene, pentamethylene. The substituents include, for example, hydroxyl groups and lower alkyl groups each having 1 ~ 3 carbon atoms, such as a methyl, ethyl and propyl group.

Some typical examples of the preferable compounds represented by the foregoing Formula B-I will be given below.

B-1

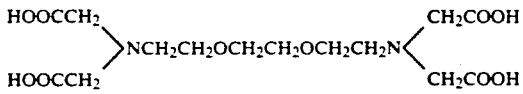

B-2

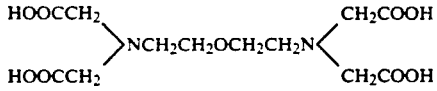

B-3

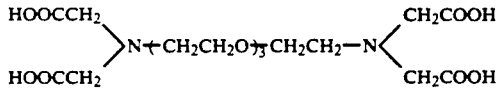

B-4

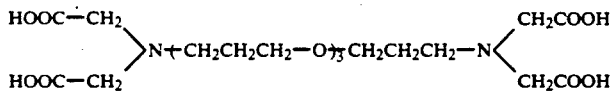

B-5

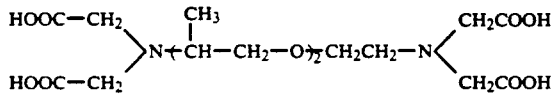

B-6

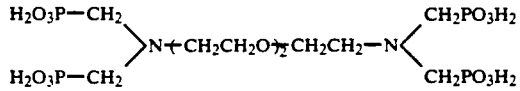

-continued

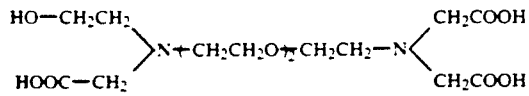

B-7

For the ferric complex salts of the compounds B-1 ~ B-7, any one of ferric sodium, potassium and ammonium complex salts thereof may be used.

For embodying the invention, a preferable mode is to contain ammonium salts in an amount of not more than 50 mol %, preferably not more than 20 mol % and particularly not more than 10 mol %, because the bleaching agents represented by the foregoing formula A-I or B-I have a substantially high oxidizing property and from the aspect of keeping a pollution abatement.

Among the examples of the compounds above, B-1, B-2 and B-7 and, inter alia, B-1 are preferably used.

Such ferric complex salts of organic acids are added in an amount within the range of, preferably, 0.1 ~ 2.0 mols and, more preferably, 0.15 ~ 1.5 mols per liter of a bleaching solution used.

Besides the above-given compounds represented by Formula A-I or B-I, the other preferable bleaching agents useful in the bleaching solutions of the invention may be exemplified by the ferric complex salts of the following compounds, such as those of ammonium, sodium, potassium and triethanolamine. However, there is no limitation thereto.

A'-1 Ethylenediaminetetraacetic acid
A'-2 Trans-1,2-cyclohexanediaminetetraacetic acid
A'-3 Dihydroxyethylglycinic acid
A'-4 Ethylenediaminetetrakismethylenephosphonic acid
A'-5 Nitrilotrismethylenephosphonic acid
A'-6 Diethylenetriaminepentakismethylenephosphonc acid
A'-7 Diethylenediaminepentaacetic acid
A'-8 Ethylenediaminediorthohydroxyphenylacetic acid
A'-9 Hydroxyethylethylenediaminetriacetic acid
A'-10 Ethylenediaminedipropionic acid
A'-11 Ethylenediaminediacetic acid
A'-12 Hydroxyethyliminodiacetic acid
A'-13 Nitrilotriacetic acid
A'-14 Nitrilotripropionic acid
A'-15 Triethylenetetraminehexaacetic acid
A'-16 Ethylenediaminetetrapropinoic acid In the bleaching solutions, the ferric complex salts of the compounds represented by Formula A or B and one kind or not less than two kinds of the ferric complex salts of the compounds A'-1 ~ A'-16 may be used, in combination.

When using not less than two kinds of the ferric complex salts of organic acids in combination, the ferric complex salts of the compounds represented by Formula A or B are contained in a proportion of, preferably not less than 70%, more preferably not less than 80%, particularly not less than 90%, in terms of mols and, most preferably not less than 95%, from the viewpoint of excellently displaying the advantages of the invention.

Also from the viewpoint of rapid processability, ammonium is preferably used as the cations of the above bleaching agents. However, due to the high oxidizing property of the bleaching agents as described above, potassium salts, sodium salts and amine type salts such as those of alkanolamine other than those of ammonium may be used to provide a preferable embodiment. In this instance, it is advisable to use the ammonium salts in an amount of not more than 50 mol % of the whole cation, preferably not more than 20 mol % and more preferably not more than 10 mol % so that the above-mentioned advantages of the invention may be displayed.

It is allowed to use iron (III) complex salts of organic acids in the form of complex salts. It is also allowed to produce an iron (III) ion complex salt in a solution by the use of iron (III) salts including, for example, such as ferric sulfate, ferric ammonium sulfate and ferric phosphate, and aminopolycarboxylic acid or its salts thereof. In the case of using such iron (III) salts in the form of complex salts, it is allowed to use the complex salts independently or in combination. In the case where a complex salt is produced in a solution by the use of ferric salt and aminopolycarboxylic acid, one or more kind of ferric complex salts may be used independently or in combination. It is also allowed to use one or more kinds of aminopolycarboxylic acids. In any one of the cases, amino- polycarboxylic acids may be used in an excessive amount more than to produce an iron (III) ion complex salts.

In a bleach-fixer or a bleaching solution each containing the above-described iron (III) ion complexes, metal ion complex salts such as those of cobalt, copper, nickel or zinc other than iron may also be contained.

When a bleaching solution contains imidazole and the derivatives thereof each described in Japanese Patent O.P.I. Publication No. 1-295258/1989, the compounds represented by Formulas I ~ IX each described in the same publication and at least one kind of these exemplified compounds, a rapid processability can be displayed effectively.

Besides the above-described bleach accelerators, it is also allowed to similarly use the exemplified compounds described in Japanese Patent O.P.I. Publication No. 62-123459, pp. 51-115, the exemplified compounds described in Japanese Patent O.P.I. Publication No. 63-17445/1988, pp. 22-25, and the compounds described in Japanese Patent O.P.I. Publication Nos. 53-95630/1978 and 53-28426/1978.

These bleach accelerators may be used independently or in combination. Generally, they may be added in an amount within the range of, preferably about 0.01 ~ 100 g per liter of a bleaching solution used, more preferably 0.05 ~ 50 g and, more preferably 0.05 ~ 15 g.

When adding the bleach accelerators, they may be added as they are. It is however usual to add them after they are dissolved in advance in water, alkali or organic acid. If required, there may be some instances where they are added after dissolving them in an organic solvent such as methanol, ethanol or acetone.

Such bleaching solution ma be used at a temperature within the range of 20° C. ~ 50° C. and, desirably, 25° C. ~ 45° C.

The bleaching solution is to have a pH of, preferably, not higher than 6.0 and, more preferably, within the range of not lower than 1.0 to not higher than 5.5.

The pH value of a bleaching solution means the pH of a processing tank used when processing a silver halide light-sensitive material. This pH value is to be discriminated clearly from the pH value of a replenisher.

A bleaching solution is normally used upon adding a halide such as ammonium bromide, potassium bromide or sodium bromide thereto. It is also allowed to contain therein a variety of fluorescent whitening agents, defoaming agents or surfactants.

The bleaching solution is replenished in an amount of not more than 500 ml per sq. meter of a silver halide color photographic light-sensitive material processed, preferably 20 ml to 400 ml and, most preferably 40 ml to 350 ml. The more the effects of the invention can be displayed remarkably when replenishing amount is lower.

In the invention, if desired, the air or oxygen may be blown in a processing bath and a processing replenisher reservoir tank, or an appropriate oxidizer such as hydrogen peroxide, a bromate or a persulfate may be suitably added, for the purpose of improving the activity of a bleaching solution, In a fixing step following after a bleaching step, as mentioned above, a thiosulfate in an amount of at least 0.2 mols per liter is used as a fixing agent applicable to a fixer. When it is used with a thiocyanate in combination, a run-down trouble can be improved. Such a thiocyanate may be added in an amount within the range of, preferably 0.1 to 3.0 mols per liter and, more preferably 0.2 to 2.5 mols per liter.

The fixers may also contain a single or plural kinds of pH buffers comprising various salts such as those of boric acid, borax, sodium hydroxide, potassium hydroxide, sodium carbonate, potassium carbonate, sodium bicarbonate, potassium bicarbonate, acetic acid, sodium acetate, ammonium hydroxide and so forth, as well as the above-described fixing agents.

It is further desirable to contain a large amount of rehalogenizers including, for example, alkali halides or ammonium halides, such as potassium bromide, sodium bromide, sodium chloride and ammonium bromide. It is also allowed to suitably add the pH buffers such as a borate, oxalate, acetate, carbonate or phosphate, and the compounds such as alkylamines and polyethylene oxides which are known as the additives.

In the fixers of the invention, when ammonium ions are used in an amount of not more than 50 mol % of the whole cation, preferably not more than 20 mol % and, particularly within the range of 0 to 10 mol %, stains can be prevented in the course of processing with the fixer directly from a bleaching solution, and the invention can preferably be embodied so that a low pollution can also be embodied by reducing an ammonium ion content. When reducing the ammonium ion content, there may be some instances where the fixability may be affected. It is, therefore, a more preferable embodiment to make a combination use of a thiocyanate in an amount within the range of not less than 0.1 mols to the order of 3.0 mols per liter, or to use a thiosulfate in a concentration of not less than 0.5 mols per liter, preferably not less than 1.0 mols per liter and, more preferably within the range of 1.2 mols per liter to 2.5 mols per liter.

Silver may be recovered from a fixer in a known method. For example, an electrolysis method described in French Patent No. 2,299,667, a precipitation method described in Japanese Patent O.P.I. Publication No. 52-73037/1977 and German Patent No. 2,331,220, an ion-exchange method described in Japanese Patent O.P.I. Publication No. 51-17114/1976 and German Patent No. 2,548,237, and a metal substitution method described in British Patent No. 1,353,805, may effectively be utilized.

It is particularly preferable to recover silver in line from a solution contained in a tank in an electrolytic silver recovery method or by making use of an anion-exchange resin, because a rapid processing aptitude can further be improved. However, It is also allowed to recover silver from an overflow waste so as to reuse the silver.

The fixer may be relenished in an amount of, preferably not more than 1200 ml per sq. meter of a light-sensitive material, more preferably within the range of 20 ml to 1000 ml and particularly within the range of 50 ml to 800 ml.

The fixer is preferable to have a pH value within the range of 4 to 8.

The fixer may be added by the compounds represented by Formula FA given in Japanese Patent O.P.I. Publication No. 1-295258/1989, p. 56. This also gives such a different effect that very few sludges may be produced when processing a small quantity of light-sensitive materials extending over a long period of time by the use of a bleach- fixer or a fixer.

The compounds represented by Formula FA given in the same Patent Application may be synthesized in any ordinary methods such as those described in U.S. Pat. Nos. 3,335,161 and 3,260,718. These compounds may be used independently or in combination.

The compounds represented by Formula FA may be added in an amount within the range of 0.1 g ~ 200 g per liter of a processing solution used, so that a good result can be obtained.

A fixer may be used with a sulfite and a sulfurous acid releasable compound. The typically exemplified compounds include potassium sulfite, sodium sulfite, ammonium sulfite, ammonium hydrogen sulfite, potassium hydrogen sulfite, sodium hydrogen sulfite, potassium hydrogen sulfite, sodium hydrogen sulfite, potassium metabisulfite, sodium metabisulfite, ammonium metabisulfite. Further, the compounds represented by Formula B-1 or B-2 given in Japanese Patent O.P.I. Publication No. 1-295258/1989, p. 60 may also be included therein.

These sulfites and sulfurous acid releasable compounds are required to add in an amount, in terms of sulfite ions, of at least 0.1 mols per liter of a fixer used. The amount thereof added is within the range of, preferably 0.12 mols/l to 0.65 mols/l, more preferably 0.15 mols/l to 0.50 mols/l and, particularly 0.20 mols/l to 0.40 mols/l.

When using the bleacher and fixer each relating to the invention, any processing time may be taken, however, it is advisable to take a processing time of preferably not longer than 4 minutes 30 seconds, ore preferably within the range of 20 seconds to 3 minutes 20 seconds, further preferably within the range of 40 seconds to 3 minutes and particularly within the range of 60 seconds to 2 minutes 40 seconds.

In the processing methods of the invention, it is preferable that treatments with bleacker and fixer are carried out by applying a forced stirring. Because of the viewpoints that not only the objective advantages of the invention can excellently be displayed, but also a rapid processing aptitude can be improved. The expression, 'a forced stirring ', does no therein mean that a liquid is normally diffusively moved, but means that the liquid is forcedly stirred by an auxiliary stirring means. The means described in Japanese Patent O.P.I. Publication No. 1-222259/1989 and Japanese Patent O.P.I. Publication No. 1-206343/1989 may be adopted as the forced stirring means.

In embodiments of the invention, when it is taken a cross-over time for not longer than 10 seconds and preferably not longer than 7 seconds between the tanks such as a color developing tank and a bleaching or bleach-fixing tank, a bleaching fog prevention, can be obtained and, on the other hand, it is also preferable for the embodiment of the invention to adopt a method in which a duckhill valve is so provided as to reduce an amount of a processing solution carried with a light-sensitive material processed.

The color developing agents applicable to a color developing step include, for example, an aminophenol type compounds and a p-phenylenediamine type compounds. In the invention, p-phenylenediamine type compound each having a water-soluble group are preferably used.

At least one of the water-solubilizing groups is positioned to the amino group or a benzene nucleus of the p-phenylene-diamine type compound. The typical water-solubilizing groups include, for example, the following groups:

$-(CH_2)_n-CH_2OH$, $-(CH_2)_m-NHSO_2-(CH_2)_n-CH_3$, $-(CH_2)_m-O-(CH_2)_n-CH_3$, $-(CH_2CH_2O)_nC_mH_{2m+1}$ wherein m and n each are 0 or an integer. They include, preferably, —COOH or $-SO_3H$ group.

The following compounds will be typically exemplified as the color developing agents preferably applicable to the invention.

Exemplified color developing agents

A-1

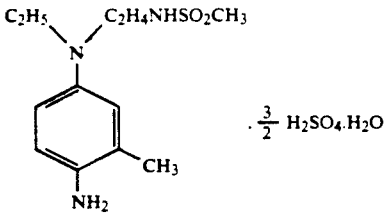

A-2

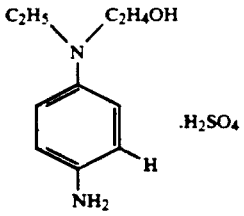

A-3

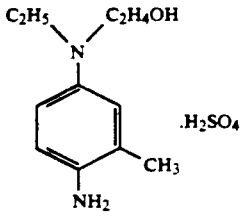

-continued

Exemplified color developing agents

A-4

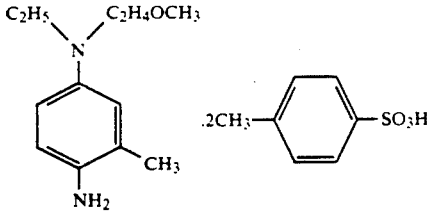

A-5

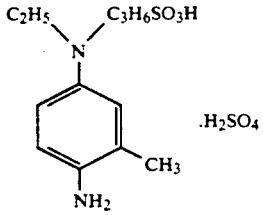

A-6

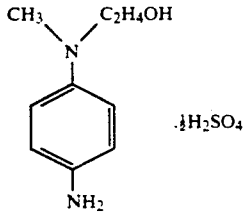

A-7

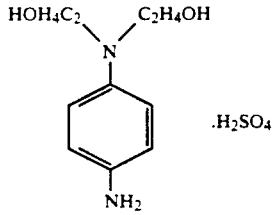

A-8

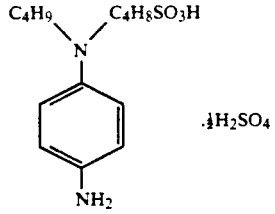

A-9

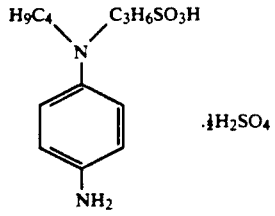

A-10

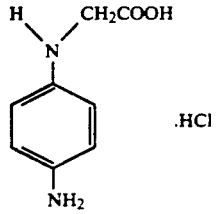

-continued

Exemplified color developing agents

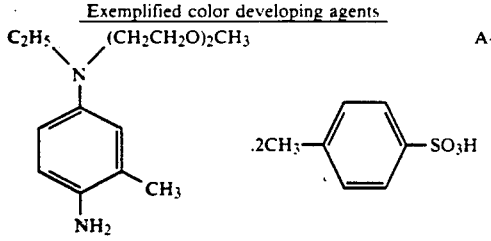

A-11

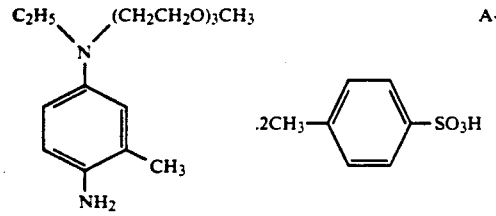

A-12

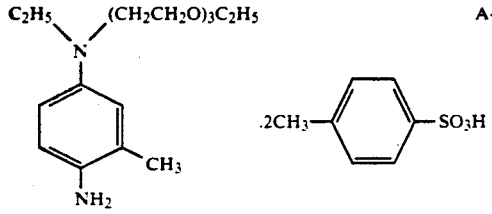

A-13

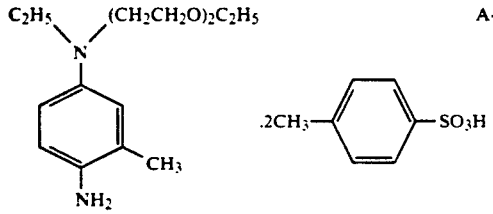

A-14

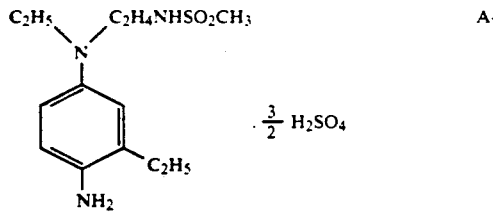

A-15

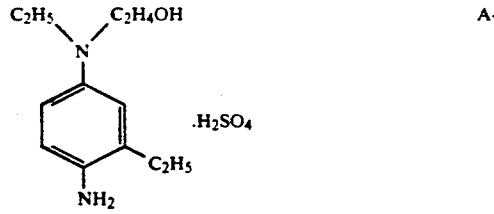

A-16

Among the color developing agents exemplified above, Exemplified Compound Nos. A-1, A-2, A-3, A-4, A-6, A-7 and A-15 and, inter alia, A-1 or A-3 are preferably used.

The above-given color developing agents are usually used in the form of salts such as a hydrochloride, sulfate, p-toluenesulfonate.

A color developer is permitted to contain alkalinizers which are usually used in a developer, such as sodium hydroxide, potassium hydrooxide, amonium hydroxide, sodium carbonate, potassium carbonate, sodium sulfate, sodium metaborate or borax. In addition to the above, a variety of additives ay be added thereto. The additives include, for example, benzyl alcohol, alkalihalides such as potassium bromide or potassium chloride, developing controlling agents such as citrazinic acid, and preservatives such as hydroxylamine, and the derivatives thereof such as diethylhydroxylamine, hydrazine derivatives such as hydroazindiacetic acid, or a sulfite.

It is allowed to suitably add various kinds of defoaming agents, surfactants and organic solvents such as methanol, dimethylformamide or dimethylsulfoxide.

The pH values of the color developers are usually not lower than 7 and preferably within the range of about 9~13.

If required, the color developers are allowed to contain anti-oxidizing agents including, for example, tetoronic acid, tetronimide, 2-anilinoethanol, dihydroxyacetone, aromatic secondary alcohol, hydroxamic acid, pentose or hexose, pyrogallol-1,3-dimethylether.

In the color developers, it is also allowed to use a various chelating agents in combination, as a metal-ion blocking agent. The chelating agents include, for example, aminopolycarboxylic acids such as ethylenediaminetetraacetic acid and diethylenediaminepentaacetic acid diethylenetriaminepentaacetic acid; organic phosphonic acids such as 1-hydroxyethylidene-1,1-diphosphonic acid; aminopolyphosphonic acids such as aminotri-methylenephosphonic acid or ethylenediaminetetraphosphoric acid; oxycarboxylic acids such as citric acid or gluconic acid; phosphonocarboxylic acids such as 2-phosphonobutane-1,2,4- tricarboxylic acid; polyphosphoric acids such as tripolyphosphoric acid or hexametaphosphoric acid.

In a continuous processing steps for color negative films, the replenishing amount of a color developer is in an amount of preferably not more than 15.0 ml per 100 $cm^2$ of the light-sensitive material, more preferably within the range of 2.5 ml to 9.0 ml and, further preferably within the range of 3.0 ml to 7.0 ml.

Next, the silver halide color photographic light-sensitive materials applicable to the invention will be detailed.

For the silver halide grains applicable to the silver halide color photographic light-sensitive materials, any one of silver chloride grains, silver chlorobromide grains, silver iodobromide grains and silver chloroiodobromide grains may be used. Among them, silver iodobromide grains may preferably be used, from the aspect of displaying the effects of the invention.

In a light-sensitive material, an average silver iodide content of the whole silver halide emulsion thereof is within the range of preferably 0.1 to 15 mol %, more preferably 0.5 to 12 mol % and, particularly 1 to 10 mol %.

An average grain-size of the whole silver halide grain in a light-sensitive material is preferably not larger than 2.0 μm and, more preferably within the range of 0.1 to 1.2 μm.

When a silver halide emulsion contains grains having an average value of the grain-sizes/grain-thicknesses of less than 5, it is preferable that the grain-size distribution is in the monodisperse mode, from the desilvering viewpoint.

The monodispersity of the silver halide grains can be expressed by the distribution range defined by the following equation.

A grain-size distribution range is defined as follows:

$$\frac{\text{Standard deviation}}{\text{Average grain-size } \bar{r}} \times 100 = \text{Distribution range } (\%)$$

A particularly preferable high-monodisperse emulsion has a distribution range of not more than 20% and, more preferably, not more than 15%.

An average grain-size $\bar{r}$ herein means a grain-size ri obtained when a product $ni \times ri^3$ of frequencies ni and $ri^3$ each of grains having a grain-size ri. In the definition, significant figures are up to 3 figures and the figure of the lowest column is rounded to one decimal.

A grain-size expressed herein means a grain diameter in the case of a globular silver halide grain, and a diameter of a circular image having the same area converted from the projected grain image in the case of the other shaped grains than the globular shaped.

A grain-size can be obtained in the manner, for example, that a grain is photographed upon magnifying it ten thousand times to fifty thousand times through an electron microscope and the diameter of the grain printed on the photograph or the area obtained when the grain is projected. The number of grains are deemed to be 1,000 grains at random.

The silver halide grains may have any crystals such as a normal crystal, a twin crystal and other crystals. Any ratios of a [1.0.0] plane to a [1.1.1] plane may be used. The crystal structures of these silver halide grains may be a structure which is uniform from the interior through the exterior thereof or a layer-like structure which is heterogeneous between the interior and the exterior thereof, that is called a core-shell type structure. These silver halides may be of the type capable of forming a latent image mainly on the surface of the grains, or may be of the type capable of forming it inside the rains. Also, it is allowed to use the tabular-shaped silver halide grains. (For further details, refer to Japanese Patent O.P.I. Publication No. 58-113934/1983 and Japanese Patent O.P.I. Publication No. 61-47959/1986.)

It is also allowed to use the silver halide grains prepared in any one of the acidic, neutral and ammoniacal processes.

It is also allowed to use a method in which, for example, seed grains are prepared in an acidic process and are then grown in an ammoniacal process having a high growing rate so as to grow them up to a specific size. When the silver halide grains are grown, it is preferable that a pH and pAg inside a reaction vessel are controlled and silver ions and halide ions are poured and mixed gradually and at the same time in both of the amounts thereof so as to correspond to the growing rate of silver halide grains as described in Japanese patent O.P.I. Publication No. 54-48521(1979).

The composition containing the silver halide grains is herein called a silver halide emulsion.

These silver halide emulsions may be chemically sensitized by making use of the following sensitizers independently or in suitable combination. Namely, an active gelatin; sulfur sensitizers such as thiosulfate, allylthiocarbamide, thiourea and cystine; selenium sensitizers; reduction sensitizers such as stannous salts, thiourea dioxide and polyamine; noble metal sensitizers including a gold sensitizers such as potassium aurothiocyanate, potassium chloroaurate and 2-aurothio-3-methylbenzothiazolium chloride, or water-soluble salt sensitizers including those of ruthenium, palladium, platinum, rhodium and iridium, such as ammonium chloropalladate, potassium chloroplatinate and sodium chloropalladate among which some kinds thereof function as a sensitizer or a inhibitor according to an amounts thereof used. A chemical sensitization may also be made with, for example, a gold sensitizer and a sulfur sensitizer or a gold sensitizer and a selenium sensitizer each in suitable combination.

In the case of silver halide emulsions are chemically ripened by adding a sulfur-containing compound, before, during or after the chemical ripening, at least one kind each of hydroxyzaindenes and nitrogen-containing heterocyclic compounds having a mercapto group may be added.

Silver halides may be optically sensitized by adding a sensitizing dye in an amount within the range of, for example, $5 \times 10^{-8}$ to $3 \times 10^{-3}$ mols per mole of silver halide used so as to provide sensitivity to each of desired light-sensitive wavelength regions. As for the sensitizing dyes, those of various types may be used independently or in combination.

It is preferable that a light-sensitive material is to contain couplers, which are compounds capable of producing dyes upon reaction with the oxidized products of a color developing agent, into its red, blue and green light-sensitive emulsion layers, respectively.

Among the applicable yellow couplers, closed-chain ketomethylene compounds; so-called 2-equivalent couplers such as an active siteo-aryl-substituted coupler, an active siteo-acyl-substituted coupler, an active site hydantoin compound-substituted coupler, and an active site urazole compound-substituted coupler; and an active site succinimide compound-substituted coupler, an active site fluorine-substituted coupler, an active site chlorine or bromine-substituted coupler and an active siteo-sulfonyl substituted coupler; may effectively be used. The typical examples of the applicable yellow couplers include those described in U.S. Pat. Nos. 2,875,057, 3,265,506, 3,408,194, 3,551,155, 3,582,322, 3,725,072, 3,891,445, 3,933,501, 4,022,620, 4,326,024 and 4,401,752, West German Patent No. 1,547,868, West German Patent Application Laid-Open-to-Public Nos. 2,219,917, 2,261,361 and 2,414,006, British Patent Nos. 1,425,020 and 1,476,760, Japanese Patent Examined Publication No. 51-10783/1976, Japanese Patent O.P.I. Publication Nos. 47-26133/1972, 48-73147/1973, 51-102636/1976, 50- 6341/1975, 50-123342/1975, 50-13042/1975, 51-21827/1976, 50- 876509/1975, 52-82424/1977, 52-115219/19787, 58-95346/1983 and 1-180542/1989.

The applicable magenta couplers include, for example, the compounds of pyrazolone type, pyrazolotriazole type, pyrazolinobenzimidazole type and indazolone type. Similar to the case of the yellow couplers, these magenta couplers may be not only 4-equivalent type couplers but also 2-equivalent type couplers. The typical examples of the applicable magenta couplers include those described in U.S. Pat. Nos. 2,600,788, 2,983,608, 3,062,653, 3,127,269, 3,311,476, 3,419,391, 3,519,429, 3,558,319, 3,582,322, 3,615,506, 3,834,908, 3,891,445, 4,310,619, 4,351,897, 4,500,630 and 4,540,654, West German Patent No. 1,810,464, West Germany Patent Application (OLS) Nos. 2,408,665, 2,417,945 and 2,424,467, Japanese Patent Examined Publication No. 40-6031/1965, Japanese Patent O.P.I. Publication Nos. 51-20826/1974, 52-58922/1977, 49-129538/1974, 49-74027/1974, 50-159336/1975, 52-42121/1977, 49-74028/1974, 50-60233/1975, 51-26541/1976, 53-55122/1978 and 60-43659/1985, and European Patent No. 73636.

The applicable cyan couplers include, for example, those of phenol and naphthol types. Similar to the case of the yellow couplers, these cyan couplers may be not only 4-equivalent type couplers but also 2-equivalent type couplers. The typical examples of the applicable cyan couplers include those described in U.S. Pat. Nos. 2,369,929, 2,434,272, 2,474,293, 2,521,908, 2,895,826, 3,034,892, 3,311,476, 3,458,315, 3,476,563, 3,583,971, 3,591,383, 3,767,411, 3,772,002, 3,933,494, 4,004,929, 4,052,212, 4,148,396, 4,228,233, 4,296,200, 4,334,001, 4,237,173, 4,451,559 and 4,427,767, European Patent Nos. 121365A and 161626A, West German Patent Application (OLS) Nos. 2,414,830 and 2,454,329, Japanese Patent O.P.I. Publication Nos. 48-5983/1973, 51-26034/1976, 48-5055/1973, 51-146827/1976, 52-69624/1977, 52-90932/1977 and 58-95346/1983, and Japanese Patent Examined Publication No. 49-11572/1974.

In silver halide emulsion layers and other photographic component layers, couplers such as colored magenta or cyan couplers, polymer couplers and so forth may be used in combination. For further details of colored magenta or cyan couplers, refer to Japanese Patent O.P.I. Publication No. 61-72235/1986 that was applied by the present patent applicant.

For further details of polymers couplers, refer to Japanese Patent O.P.I. Publication No. 61-50143 applied by the present patent applicant.

In photo graphic light-sensitive materials used in the invention, from the viewpoints of the objective effects of the invention and, especially, of the rapid processability, it is preferable that the following couplers are used in combination with a light-sensitive material of the invention.

The preferable magenta couplers are ones represented by the following Formula M-I:

Formula M-I

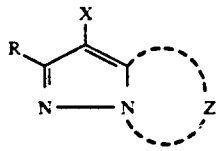

wherein Z is a group of non-metal atoms necessary for forming a nitrogen containing heterocyclic ring which may be have a substituent; X is a hydrogen atom or a substituent capable of splitting off upon reaction with the oxidiation product of a color developing agent; and R is a hydrogen atom or a substituent.

The concrete compounds represented by Formula M-I are described in Japanese Patent O.P.I. Publication No. 63-106655/1988.

As the cyan couplers, ones represented by the following formula C-I or C-II are preferably used.

Formula C-I

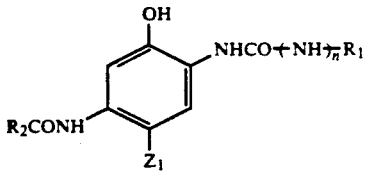

-continued

Formula C-II

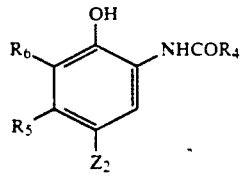

in these formula, $R_1$, $R_2$ and $R_4$ each represents an aliphatic group, an aryl group or a heterocyclic group, each of which may have a substituent; $R_3$ and $R_6$ each represents a hydrogen atom, or an aliphatic group, an aryl group or an acylamino group, each of which m ay have a substituent, provided that $R_3$ is allowed to link with $R_2$ to form a ring; $R_5$ is an alkyl group which may have a substituent; $Z_1$ and $Z_2$ each represents a hydrogen atom or a substituent capable of splitting off upon reaction with the oxidation product of a color developing agent; and n is zero or 1.

As the yellow couplers, high-speed reactive yellow couplers having a relative coupling speed of not less than 0.3, preferably not less than 0.5, are preferably used.

The coupling reaction rate of a coupler can be determined in terms of relative values in the following manner: A mixture of two kinds of couplers M and N each of which can provide the different dyes capable of being clearly separated from each other, the foregoing mixture is added to a silver halide emulsion. This coupler-added emulsion is color-developed, thereby resulting a color image. Then, the dye contents of the color image are measured.

The reaction activity ratio of coupler M to coupler N, RM/RN, can be expressed by the following formula:

$$\frac{RM}{RN} = \frac{\log\left(1 - \frac{DM}{(DM)\text{max.}}\right)}{\log\left(1 - \frac{DN}{(DN)\text{max.}}\right)}$$

Wherein (DM)max. represents a maximum color density of coupler M, DM represents a color density of coupler M in an intermediate stage, (DN)max. represents a maximum color density of coupler N, and DN represents a color density of coupler N is an intermediate stage.

In short, a silver halide emulsion containing mixed couplers is exposed to variously stepped light and is then color-developed. The resulting several series of DMs and DNs are plotted on with respect to two axes each crossed at right angles, interms of the following formulas:

$$\log\left(1 - \frac{DM}{DM\text{max}}\right), \log\left(1 - \frac{DN}{DN\text{max}}\right)$$

From the inclination of the straight line obtained by the plots, a coupler reactivity ratio, an RM/RN value, can be obtained.

When using a specific coupler N and obtaining the RM/RN values of various kinds of couplers in the above-described manner, the relative values of the coupling reaction rates of the couplers, i.e., the relative coupling reaction rate values, can be obtained.

Relating to the invention, there uses the RM/RN value obtained when using the following coupler for the above-mentioned coupler N.

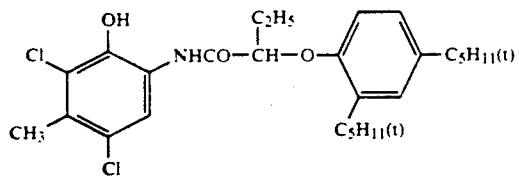

In the invention, the amounts of the high-speed reactive yellow couple are not limitative to be added, and they may be added in an amount within the range of, preferably, $2\times10^{-3}$ to $5\times10^{1}$ mols and, more preferably, $1\times10^{-2}$ to $5\times10^{-1}$ mols, per mol of the silver content of a blue light-sensitive silver halide emulsion layer used.

The above-mentioned yellow couplers are described, for example, in Japanese Patent O.P.I. Publication 63-106655/1988.

As the preferable yellow couplers, ones represented by the following formula Y are also used:

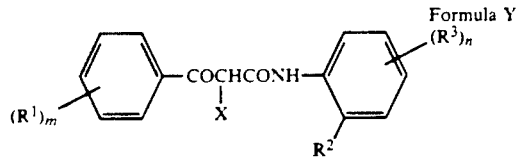

in the formula, $R^1$ and $R^3$ each represents a substituent; $R^2$ is a hydrogen atom, a halogen atom or an aliphatic oxy group; m is zero or an integer of 1 to 5 and n is zero or an integer 1 to 4; X is substituent capable of splitting off upon reaction with the oxidation product of a primary aromatic amine color developing agent, provided that a plurality of $R^1$ may be the same or different from each other when m is 2 to 5, and a plurality of $R^3$ may be the same or different from each other when n is 2 to 4, and $R^1$, $R^2$, $R^3$ or X may be a 2- to 4-valent bonding group to form a dimer, trimer or tetramer of the coupler. This type of couplers are described in Japanese Patent O.P.I. Publication No. 1-180542/1989.

It is another preferable embodiment to use a bleaching accelerator releasing compound, BAR compounds, or to use the silver salt type bleach accelerators described in EPO Nos. 317951 and 317950, which can display the effects of the invention including especially a rapid processability and desilvering property.

The BAR compounds can be synthesized referring the methods mentioned in Japanese Patent O.P.I. Publication Nos. 61-201247/1986, 55-25056/1980, 55-29805/1980, 60-50533/1985, 61-28947/1986, 62-56963/1987, 62-173467/1987, 62-247363/1987, 63-70854/1988, 63-106748/1988, 63-121843/1988, 63/121844/1988, 63-212854/1988, 63-214752/1988, 63-254452/1988, 64-21159/1989, 1-201657/1989, 1-0207747/1988, 1-209447/1989, 1-214847/1989, 1-231049/1988.

Adding amount of the BAR compound to the light-sensitive material is preferably $1\times10^{-7}$ mol to $1\times10^{-1}$ mol, more preferably $1\times10^{-6}$ mol to $5\times10^{-5}$ mol, per square meter of the light-sensitive material. The BAR compound may be added to any layer, of the light-sensitive material. And the compound may be added in two or more layers of the light-sensitive material. It is preferable to add the compound to an emulsion layer of the light-sensitive material.

When using a high silver chloride-containing light-sensitive material, it is preferable to use a nitrogen-containing heterocyclic mercapto compound in combination.

The typical examples of the nitrogen-containing heterocyclic mercapto compounds are given, for example, in Japanese Patent O.P.I. Publication No. 63-106655/1988.

Besides, light-sensitive materials are allowed to contain a variety of photographic additives such as described in Research Disclosure No. 17643. For example, antifoggants, stabilizers, UV-absorbents, anticolorstaining agents, fluorescent whitening agents, anticolor-fading agents for color images, antistatic agents, alyer-hardeners, surface active agents, plasticizers, wetting agents may be used therein.

In the invention, the hydrophilic colloids useful to prepare emulsions include, preferably, gelatin and, besides, other proteins such as gelatin derivatives, graft polymers of gelatin and other high molecular substances, albumin and casein; cellulose derivatives such as hydroxyethyl cellulose derivatives and carboxymethyl cellulose derivatives; hydrophilic synthetic homo- or co-polymer such as polyvinyl alcohol, polyvinyl imidazole and polyacryl amides.

The supports for light-sensitive materials include, for example, polyester films such as those made of cellulose acetate, cellulose nitrate or polyethyleneterephthalate; films made of polyamides, polycarbonates or polystyrenes; transparent supports each provided with a reflection layer, such as glass plates; and so forth. Besides the above, any ordinary type transparent supports may also be used. These supports may suitably be selected to meet the purposes of using light-sensitive materials.

For the purpose of coating silver halide emulsion layers and other photographic component layers, various coating methods such as a dip-coating, ari-doctor coating, curtain-coating or hopper-coating method may be used. It is also allowed to use a simultaneous coating method in which not less than two layers are coated at the same time, such as the methods described in, for example, U.S. Pat. Nos. 2,761,791 and 2,941,898.

Each emulsion layer may be coated to any positions as desired. In the case of a photographic full color negative light-sensitive material for picture-taking use, for example, it is preferable to arrange a red light-sensitive silver halide emulsion layer, a green light-sensitive silver halide emulsion layer and a blue light-sensitive silver halide emulsion layer in order from a support side. Each of these light-sensitive silver halide emulsion layers is permitted to comprise two or more layers.

In light-sensitive materials which are to be processed in the invention, an interlayer having a suitable thickness may be provided thereto so as to meet the purposes of using the light-sensitive material. Besides other layers such as the interlayers, various layers such as a filter layer, a non-curling layer, a protective layer, and an antihalation layer may be used in suitable combination as the component layers. These component layers may similarly be applied with such a hydro- philic colloid applicable to emulsion layers as those afore-mentioned so as to serve as a binder. These component layer are also allowed to contain various photographic additives which may be added in such an emulsion layer as aforementioned.

The methods of processing the light-sensitive materials of the invention can be applied to any light-sensitive materials including, for example, color negative films, color papers, color positive films, color reversal slide films, color reversal movie films, color reversal TV films, color reversal papers, provided, the light-sensitive material is that is processed in the so-called coupler-in-emulsion type developing process. Among them, silver halide color photographic light-sensitive materials for picture-taking use are preferably processed in the methods.

According to the invention, the following advantages (1) through (7) can be enjoyed in the process comprising the steps of color-developing, and bleaching and fixing or bleach-fixing a silver halide photographic light-sensitive material.

(1) The invention makes it possible to improve a process using a stabilizer which causes a run-down trouble to the back surface of a film, with preventing dyes from color-fading, (2) The invention makes it possible to reduce or eliminate the use of formalin as an ingredient of a stabilizer and, therefore, the safety of the working surroundings of photofinishing laboratories.

(3) The invention makes it possible to improve an antistatic property.

(4) The invention makes it possible to eliminate the use of washing water substantially and to save resources and energies.

(5) The invention makes it possible to inhibit a stabilizing tank from staining so as to perform a stable processing.

(6) The invention makes it possible to process a small quantity of light-sensitive materials stably and for a long time.

(7) The invention makes it possible to perform stable processing even if a stabilizer is reduced to be replenished.

EXAMPLE

Example 1

In every example described herein, every amount added into a silver halide photographic light-sensitive material will be indicated in terms of gram per square meter of the light-sensitive material, unless otherwise expressly stated herein. And, silver halides and colloidal silver will be converted into silver.

Multilayered color photographic light-sensitive material sample 1 was prepared by forming the layers having the following compositions on a triacetyl cellulose film support, in order from the support side.

| Sample 1 | |
|---|---|
| Layer 1: An antihalation layer | |
| Black colloidal silver | 0.18 |
| UV absorbent, UV-1 | 0.20 |
| Colored coupler, CC-1 | 0.05 |
| Colored coupler, CM-2 | 0.06 |
| High boiling solvent, Oil-1 | 0.20 |
| Gelatin | 1.5 |
| Layer 2: An interlayer | |
| UV absorbent, UV-1 | 0.01 |
| High boiling solvent, Oil-1 | 0.01 |
| Gelatin | 1.2 |
| Layer 3: A low-speed red-sensitive emulsion layer | |
| Silver iodobromide emulsion, Em-1 | 0.9 |
| Silver iodobromide emulsion, Em-2 | 0.6 |
| Sensitizing dye, S-1 | $2.3 \times 10^{-4}$ mol/mol of Ag |
| Sensitizing dye, S-2 | $2.5 \times 10^{-4}$ mol/mol of Ag |
| Sensitizing dye, S-3 | $0.5 \times 10^{-4}$ mol/mol of Ag |
| Cyan coupler, C'-4 | 1.2 |
| Cyan coupler, C'-2 | 0.3 |
| Colored cyan coupler, CC-1 | 0.05 |
| DIR compound, D-1 | 0.002 |
| High boiling solvent, Oil-1 | 0.5 |
| Gelatin | 1.2 |
| Layer 4: A high-speed red-sensitive emulsion layer | |
| Silver iodobromide emulsion, Em-3 | 2.0 |
| Sensitizing dye, S-1 | $2.2 \times 10^{-4}$ mol/mol of Ag |
| Sensitizing dye, S-2 | $2.0 \times 10^{-4}$ mol/mol of Ag |
| Sensitizing dye, S-3 | $0.1 \times 10^{-4}$ mol/mol of Ag |
| Cyan coupler, C'-1 | 0.20 |
| Cyan coupler, C'-2 | 0.03 |
| Cyan coupler, C'-3 | 1.15 |
| Colored cyan coupler, CC-1 | 0.015 |
| DIR compound, D-2 | 0.05 |
| High boiling solvent, Oil-1 | 0.5 |
| Gelatin | 1.3 |
| Layer 5: An interlayer | |
| Gelatin | 0.5 |
| Layer 6: A low-speed green-sensitive emulsion layer | |
| Silver iodobromide emulsion, Em-1 | 1.1 |
| Sensitizing dye, S-4 | $5 \times 10^{-4}$ mol/mol of Ag |
| Sensitizing dye, S-5 | $2 \times 10^{-4}$ mol/mol of Ag |
| Magenta coupler, M'-1 | 0.45 |
| Colored magenta coupler, CM-1 | 0.05 |
| DIR compound, D-3 | 0.015 |
| DIR compound, D-4 | 0.020 |
| High boiling solvent, Oil-2 | 0.5 |
| Gelatin | 1.0 |
| Layer 7: An interlayer | |
| Gelatin | 0.9 |
| High boiling solvent, Oil-1 | 0.2 |
| Layer 8: A high-speed green-sensitive emulsion layer | |
| Silver iodobromide emulsion, Em-3 | 1.2 |
| Sensitizing dye, S-6 | $1.5 \times 10^{-4}$ mol/mol of Ag |
| Sensitizing dye, S-7 | $2.5 \times 10^{-4}$ mol/mol of Ag |
| Sensitizing dye, S-8 | $0.7 \times 10^{-4}$ mol/mol of Ag |
| Magenta coupler, M'-2 | 0.08 |
| Magenta coupler, M'-3 | 0.18 |
| Colored magenta coupler, CM-2 | 0.05 |
| DIR compound, D-3 | 0.01 |
| High boiling solvent, Oil-3 | 0.5 |
| Gelatin | 1.3 |
| Layer 9: A yellow filter layer | |
| Yellow colloidal silver | 0.12 |
| Anti-colorstaining agent, SC-1 | 0.1 |
| High boiling solvent, Oil-3 | 0.1 |
| Gelatin | 0.8 |
| Layer 10: A low-speed blue-sensitive emulsion layer | |
| Silver iodobromide emulsion, Em-1 | 0.30 |
| Silver iodobromide emulsion, Em-2 | 0.25 |
| Sensitizing dye, S-10 | $7 \times 10^{-4}$ mol/mol of Ag |
| Yellow coupler, Y-1 | 0.6 |
| Yellow coupler, Y-2 | 0.2 |
| DIR compound, D-2 | 0.01 |
| High boiling solvent, Oil-3 | 0.15 |
| Gelatin | 1.2 |
| Layer 11: A high-speed blue-sensitive emulsion layer | |
| Silver iodobromide emulsion, Em-4 | 0.50 |
| Silver iodobromide emulsion, Em-1 | 0.22 |
| Sensitizing dye, S-9 | $1.3 \times 10^{-4}$ mol/mol of Ag |
| Sensitizing dye, S-10 | $3 \times 10^{-4}$ mol/mol of Ag |
| Yellow coupler, Y-1 | 0.36 |
| Yellow coupler, Y-2 | 0.12 |
| High boiling solvent, Oil-3 | 0.07 |
| Gelatin | 1.2 |
| Layer 12: The first protective layer | |
| Fine-grained silver iodobromide emulsion (Average grain-size: 0.08 μm, AgI: 2.5 mol %) | 0.40 |

-continued

| Sample 1 | |
|---|---|
| UV absorbent, UV-1 | 0.10 |
| UV absorbent, UV-2 | 0.05 |
| High boiling solvent, Oil-1 | 0.1 |
| High boiling solvent, Oil-4 | 0.1 |
| Formalin scavenger, HS-1 | 0.5 |
| Formalin scavenger, HS-2 | 0.2 |
| Gelatin | 1.2 |
| Layer 13: The second protective layer | |
| Surfactant, Su-1 | 0.005 |
| Alkali-soluble matting agent (Average particle-size: 2 μm) | 0.10 |
| Cyan dye, AIC-1 | 0.01 |
| Magenta dye, AIM-1 | 0.01 |
| Lubricant, WAX-1 | 0.04 |
| Gelatin | 0.7 |

As well as the above-given compositions, coating aid Su-2, dispersion aid Su-3, antiseptics DI-1, stabilizer Stab-1, and antifoggants AF-1 and AF-2 were also added to each of the layers. In the sample, the following emulsions were used.

Em-1 :A monodisperse type emulsion containing a relatively smaller content of silver iodide on the surface portion, having an average grain-size of 0.46 μm and an average silver iodide content of 7.0 mol %.

Em-2 :A monodisperse type uniformly composed emulsion having an average grain-size of 0.32 μm and an average silver iodide content of 2.5 mol %.

Em-3 :A monodisperse type emulsion containing a relatively smaller content of silver iodide on the surface portion, having an average grain-size of 0.78 μm and an average silver iodide content of 6.0 mol %.

Em-4 :A monodisperse type emulsion containing a relatively smaller content of silver iodide on the surface portion, having an average grain-size of 0.95 μm and an average silver iodide content of 7.5 mol %.

Em-1, Em-3 and Em-4 were silver iodobromide emulsions having multilayer-structured silver iodobromide grains comprising mainly octahedrons, which were prepared with reference to Japanese Patent O.P.I. Publication Nos. 60-138538/1985 and 61-245151/1986.

Every one of Em-1 through Em-4 had an average grain-sizes/grains thickness of 1.0 and they also had the rain distribution broadnesses of 14%, 10% 12% and 12% respectively.

S-1

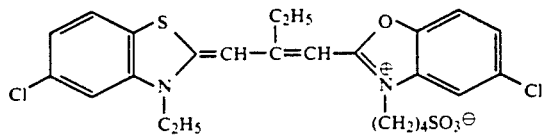

S-2

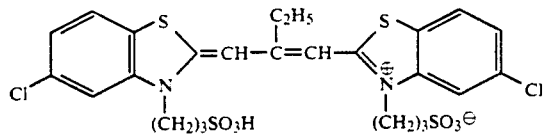

S-3

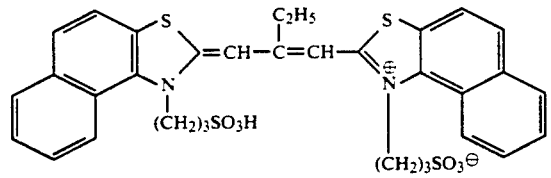

S-4

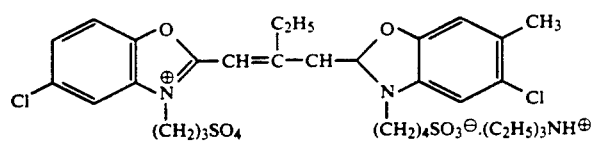

S-5

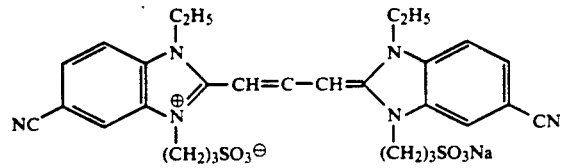

S-6

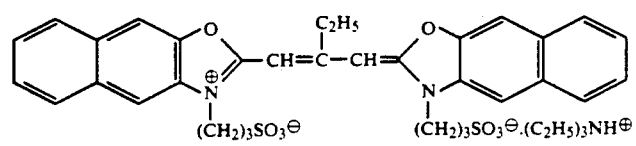

-continued
S-7
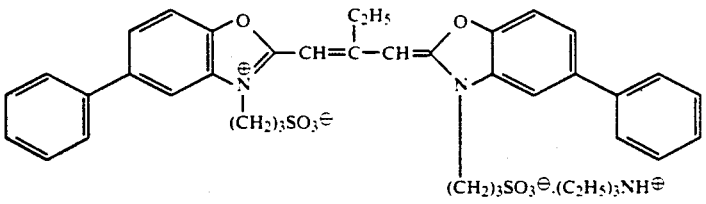
S-8
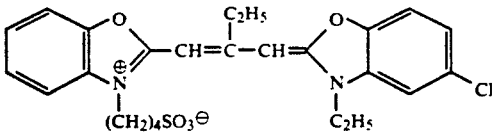
S-9
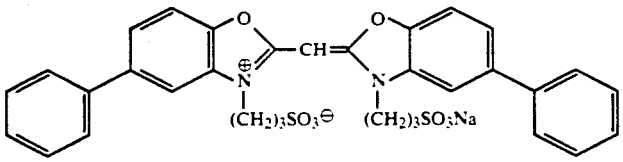
S-10
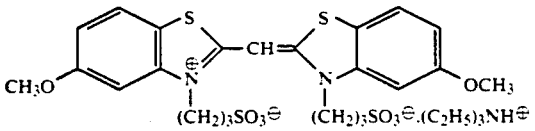
C'-1
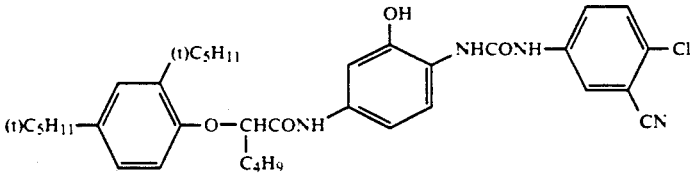
C'-2
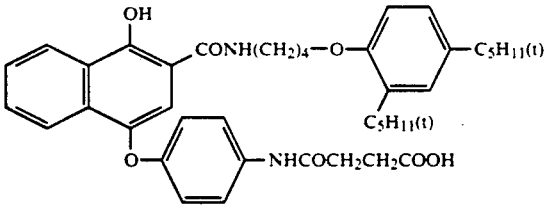
C'-3
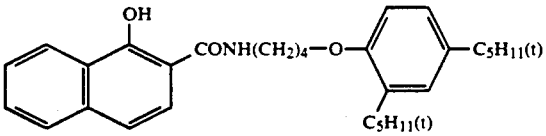
C'-4
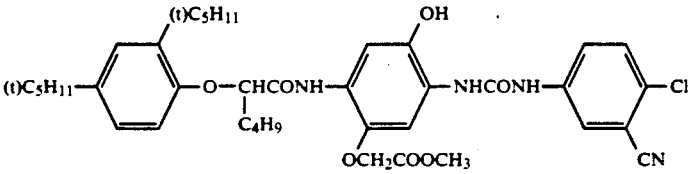
M'-1
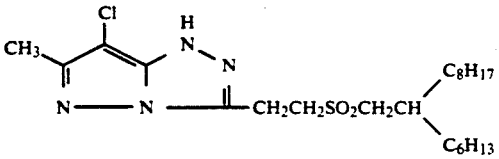

-continued
M'-2
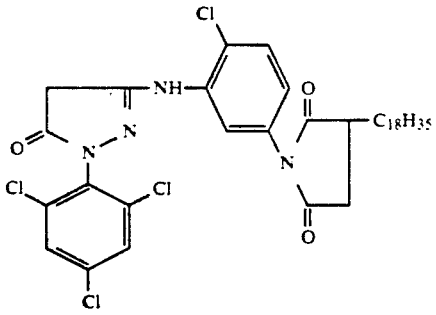
M'-3
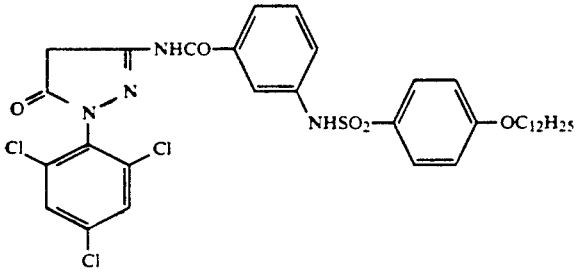
Y-1
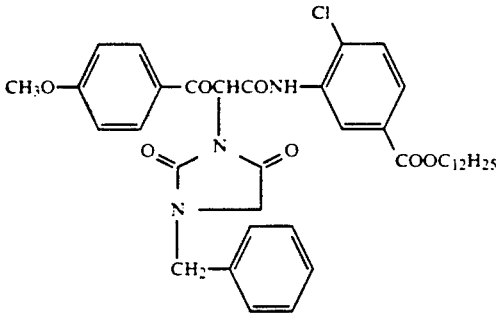
Y-2
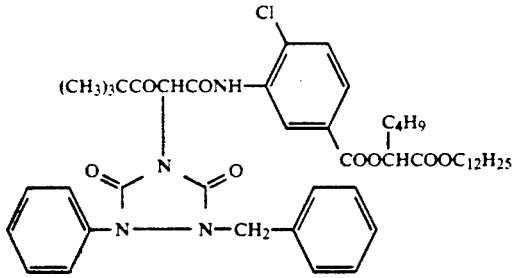
CC-1
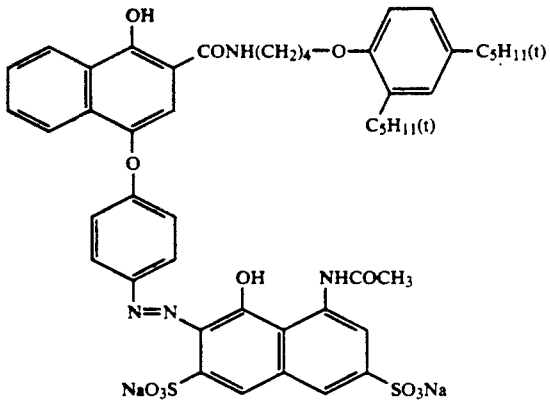

-continued
CM-1
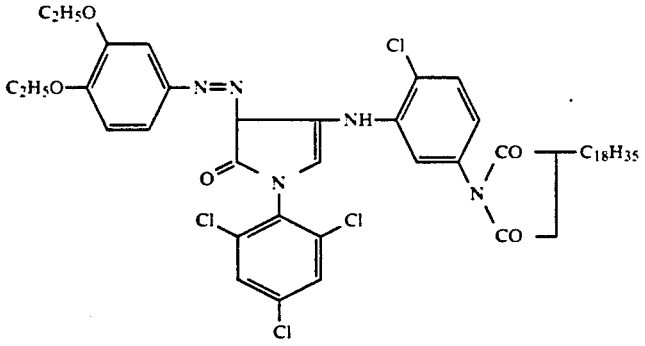
CM-2
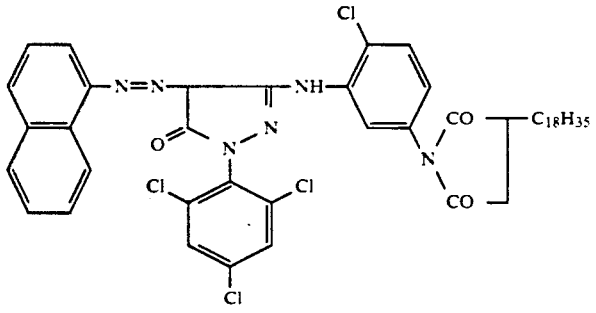
D-1
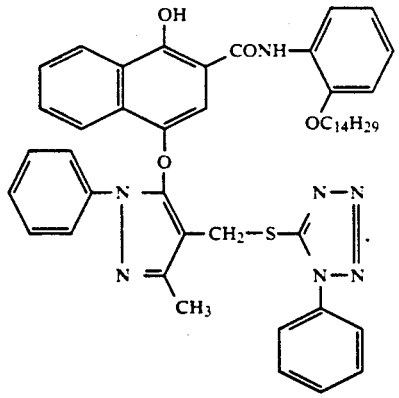
D-2
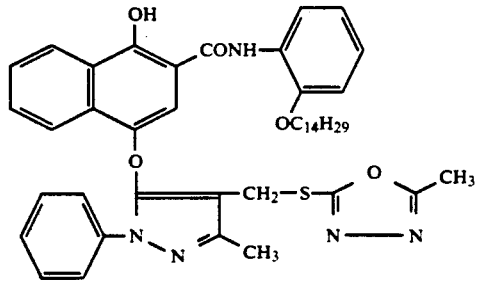

-continued
D-3
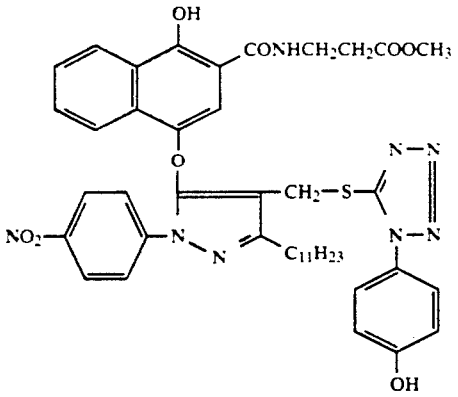
D-4
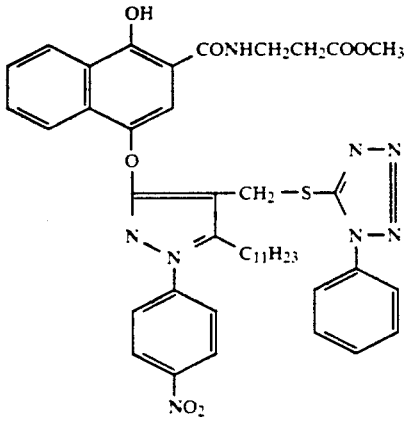
UV-1
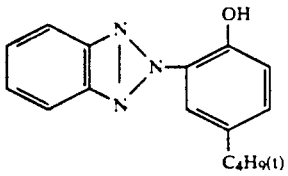
UV-2
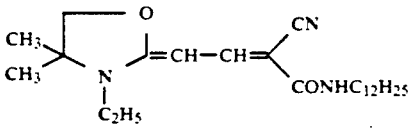
HS-1
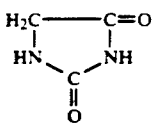
HS-2
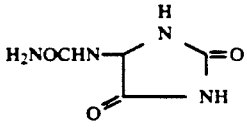
H-1
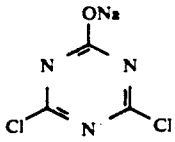
H-2
$[(CH_2{=}CHSO_2CH_2)_3CCH_2SO_2(CH_2)_2]_2N(CH_2)_2SO_3K$ -continued
Su-1
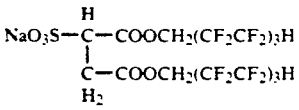
Su-2
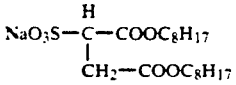
Su-3
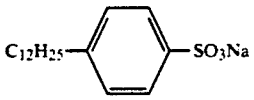
WAX-1
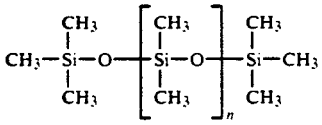
Sc-1
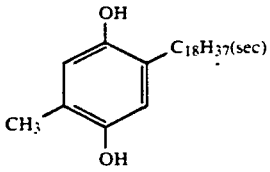
AIC-1
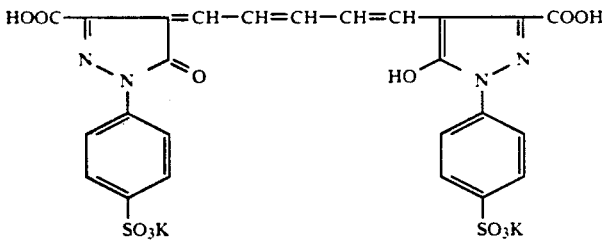
AIM-1
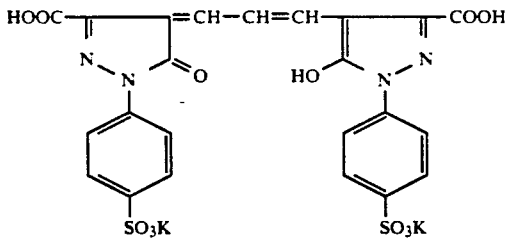
Stab-1
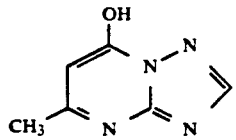
AF-1
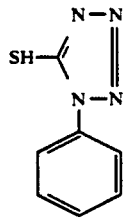

-continued

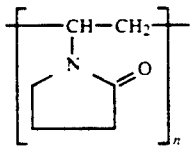

AF-2

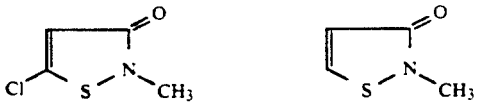

DI-1

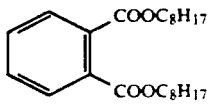

Oil-1

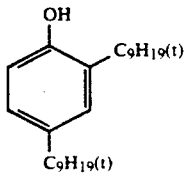

Oil-2

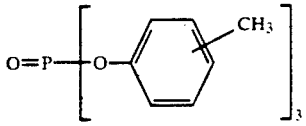

Oil-3

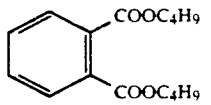

Oil-4

The film samples thus prepared were exposed to light in practical manner with the use of a camera and were then subject to running tests under the following conditions.

| Processing step | Processing time | | Processing temperature | Amount* replenished |
|---|---|---|---|---|
| Color developing | 3 min | 15 sec | 38° C. | 774 ml |
| Bleaching | | 45 sec | 38° C. | 155 ml |
| Fixing | 1 min | 30 sec | 38° C. | 500 ml |
| Stabilizing | | 50 sec | 38° C. | 775 ml |
| Drying | 1 min | | 40 to 70° C. | — |

*Amount replenished is indicated by a value per sq. meter of a light-sensitive material used.

In the running tests, the stabilizing step was carried out in a double-tank counter-current system, that is, the system in which the stabilizer was replenished to the ultimate tank and the overflow was put into the tank precedent to the ultimate tank. Further, from the stabilizing tank next to the fixing tank, a part of the overflow (in an amount of 275 ml/m$^2$) was put into the fixing tank.

The composition of the color developer used therein was as follows:

| | |
|---|---|
| Potassium carbonate | 30 g |
| Sodium hydrogencarbonate | 2.5 g |
| Potassium sulfite | 3.0 g |
| Sodium bromide | 1.2 g |
| Potassium iodide | 0.6 mg |
| Hydroxylamine sulfate | 2.5 g |

-continued

| | |
|---|---|
| Sodium chloride | 0.6 g |
| 4-amino-3-methyl-N-ethyl-N-(β-hydroxylethyl)aniline sulfate | 4.6 g |
| Diethylenetriaminepentaacetic acid | 3.0 g |
| Potassium hydroxide | 1.2 g |
| Add water to make | 1 liter |
| Adjust pH with potassium hydroxide or a 20% sulfuric acid solution to be pH 10.01 | |

The composition of the color developer replenisher used therein was as follows:

| | |
|---|---|
| Potassium carbonate | 40 g |
| Sodium hydrogencarbonate | 3 g |
| Potassium sulfite | 7 g |
| Sodium bromide | 0.5 g |
| Hydroxylamine sulfate | 3.1 g |
| 4-amino-3-methyl-N-ethyl-N-(β-hydroxylethyl)aniline sulfate | 6.0 g |
| Diethylenetriaminepentaacetic acid | 3.0 g |
| Potassium hydroxide | 2 g |
| Add water to make | 1 liter |
| Adjust pH with potassium hydroxide or a 20% sulfuric acid solution to be pH 10.12 | |

The composition of the bleaching solution used therein was as follows:

| | |
|---|---|
| Ferric ammonium 1,3-propylene-diaminetetraacetate | 0.32 mols |
| Disodium ethylenediamine-tetraacetate | 10 g |
| Ammonium bromide | 100 g |
| Glacial acetic acid | 40 g |
| Ammonium nitrate | 40 g |
| Add water to make | 1 liter |
| Adjust pH with aqueous ammonia to be pH 4.4 | |

The composition of the bleaching replenisher used therein was as follows:

| | |
|---|---|
| Ferric ammonium 1,3-propylene-diaminetetraacetate | 0.35 mols |

-continued

| | |
|---|---|
| Disodium ethylenediamine-tetraacetate | 2 g |
| Ammonium bromide | 120 g |
| Ammonium nitrate | 50 g |
| Glacial acetic acid | 40 g |
| Add water to make | 1 liter |
| Adjust pH with aqueous ammonia or glacial acetic acid to be pH 3.4 | |
| The compositions of the fixer and the fixing replenisher each used therein were as follows: | |
| Ammonium thiocyanate | 120 g |
| Ammonium thiosulfate | 200 g |
| Sodium bisulfite, anhydrous | 20 g |
| Sodium metabisulfite | 4.0 g |
| Disodium ethylenediaminetetraacetate | 1.0 g |
| Add water to make | 1 liter |
| Adjust pH with glacial acetic acid or aqueous ammonia to be pH 6.5 | |
| The compositions of the stabilizer and the stabilizing replenisher used therein were as follows: | |

| | Amount added |
|---|---|
| 1,2-benzisothiazoline-3-one | 0.1 g |
| Polyoxyalkylene type compound | (See Table 1) |
| Triazine type compound | (See Table 1) |
| Methylol type compound | (See Table 1) |
| Triethanolamine | 2.0 ml |

-continued

| | |
|---|---|
| Add water to make | 1 liter |

Adjust pH with potassium hydroxide or a 50% sulfuric acid solution to be pH7.0.

The running treatments were made by means of an automatic processor until the stabilizing replenisher was replenished twice as much as the capacity of the stabilizing tank at the time when having completed the running treatments.

At the time when the running treatments were completed, the stains produced on the inner wall of the stabilizing tank were checked up and, at the same time, the magenta density in the maximum density portion of each processed film sample was measured, further the magenta density at the same portion of the sample was re-measured of storage of the sample for 1 week at 70° C. of temperature ant 70% of relative humidity, so that the discoloration ratios of the dyes were obtained. Further, after completing the running treatments, the stains produced on the back surfaces of the processed film samples were observed.

The results thereof are shown in Table 1.

TABLE 1

| Experiment No. | Polyoxyalkylene compound (Amt. added) | Triazine compound (Amt. added) | Methylol compound (Amt. added) | Color fading ratio (%) | Back-side stain | Inner-wall stain of stabilizing tank |
|---|---|---|---|---|---|---|
| 1-1 (Comp.) | Ethylene glycol (1 g/l) | Exemp. compound (III-1) (0.5 g/l) | — | 5.9 | C | B |
| 1-2 (Comp.) | Unadded | Exemp. compound (III-1) (0.5 g/l) | — | 6.3 | CC | B |
| 1-3 (Comp.) | Exemp. compound (I-5) (1 g/l) | Unadded | — | 27.5 | C | B~A |
| 1-4 (Comp.) | Exemp. compound (I-5) (1 g/l) | Formalin (37%) (1.35 g/l) | — | 3.9 | C | CCC |
| 1-5 (Inv.) | Exemp. compound (I-5) (1 g/l) | Exemp. compound (III-1) (0.5 g/l) | — | 3.2 | A | A |
| 1-6 (Inv.) | Exemp. compound (I-1) (1 g/l) | Exemp. compound (III-1) (0.5 g/l) | — | 3.5 | A | A |
| 1-7 (Inv.) | Exemp. compound (I-6) (1 g/l) | Exemp. compound (III-1) (0.5 g/l) | — | 3.6 | A | A |
| 1-8 (Inv.) | Exemp. compound (I-12) (1 g/l) | Exemp. compound (III-1) (0.5 g/l) | — | 3.7 | A | A |
| 1-9 (Inv.) | Exemp. compound (VII-4) (1 g/l) | Exemp. compound (III-1) (0.5 g/l) | — | 3.1 | A | A |
| 1-10 (Inv.) | Exemp. compound (VII-3) (1 g/l) | Exemp. compound (III-1) (0.5 g/l) | — | 3.0 | A | A |
| 1-11 (Inv.) | Exemp. compound (VII-12) (1 g/l) | Exemp. compound (III-1) (0.5 g/l) | — | 3.3 | A | A |
| 1-12 (Inv.) | Exemp. compound (VII-14) (1 g/l) | Exemp. compound (III-1) (0.5 g/l) | — | 3.7 | A | A |
| 1-13 (Inv.) | Exemp. compound (VII-3) (1 g/l) | Exemp. compound (III-2) (0.5 g/l) | — | 3.5 | A | A |
| 1-14 (Inv.) | Exemp. compound (VII-3) (1 g/l) | Exemp. compound (III-3) (0.5 g/l) | — | 3.6 | A | A |
| 1-15 (Inv.) | Exemp. compound (VII-3) (1 g/l) | Exemp. compound (III-9) (0.5 g/l) | — | 3.9 | A | A |
| 1-16 (Comp.) | Unadded | Unadded | — | 28.4 | CC | B |
| 1-17 (Comp.) | Propylene glycol (1 g/l) | Exemp. compound (III-1) (0.5 g/l) | — | 7.5 | C | B |
| 1-18 (Comp.) | Comp. compound 1 | Exemp. compound (III-1) (0.5 g/l) | — | 5.7 | C | B |
| 1-19 (Comp.) | Comp. compound 2 | Exemp. compound (III-1) (0.5 g/l) | — | 5.5 | C | B |
| 1-20 (Comp.) | Comp. compound 3 | Exemp. compound (III-1) (0.5 g/l) | — | 5.8 | C | B |
| 1-22 (Comp.) | Polyethylene glycol (1 g/l) | Hexamethylenetetramine (0.5 g/l) | — | 9.7 | C | B |
| 1-23 (Comp.) | Polyethylene glycol (1 g/l) | Glutaraldehyde (0.5 g/l) | — | 18.5 | C | A |
| 1-24 (Comp.) | Exemp. compound (I-5) (1 g/l) | Hexamethylenetetramine (0.5 g/l) | — | 6.0 | C | B |
| 1-25 (Comp.) | Exemp. compound (I-5) (1 g/l) | Glutaraldehyde (0.5 g/l) | — | 15.5 | C | A |

TABLE 1-continued

| | | | | | | |
|---|---|---|---|---|---|---|
| 1-26 (Inv.) | Exemp. compound (I-36) (1 g/l) | — | Dimethylol urea (0.5 g/l) | 4.3 | A | A |
| 1-27 (Inv.) | Exemp. compound (I-45) (1 g/l) | — | Dimethylol urea (0.5 g/l) | 4.2 | A | A |
| 1-28 (Inv.) | Exemp. compound (I-46) (1 g/l) | — | Dimethylol urea (0.5 g/l) | 4.0 | A | A |

| Experiment No. | Surfactant (Amt. added) | Triazine compound (Amt. added) | Methylol compound (Amt. added) | Color fading ratio (%) | Rear-side stain | Inner-wall stain of stabilizing tank |
|---|---|---|---|---|---|---|
| 1-29 (Inv.) | Exemp. compound (I-47) (1 g/l) | — | Dimethylol urea (0.5 g/l) | 3.5 | A | A |
| 1-30 (Inv.) | Exemp. compound (I-72) (1 g/l) | — | Dimethylol urea (0.5 g/l) | 4.6 | A | A |
| 1-31 (Inv.) | Exemp. compound (II-5) (1 g/l) | — | Dimethylol urea (0.5 g/l) | 4.7 | A | A |
| 1-32 (Inv.) | Exemp. compound (II-9) (1 g/l) | — | Dimethylol urea (0.5 g/l) | 4.8 | A | A |
| 1-33 (Inv.) | Exemp. compound (II-10) (1 g/l) | — | Dimethylol urea (0.5 g/l) | 4.5 | A | A |
| 1-34 (Inv.) | Exemp. compound (II-11) (1 g/l) | — | Dimethylol urea (0.5 g/l) | 4.5 | A | A |
| 1-35 (Inv.) | Exemp. compound (I-47) (1 g/l) | Exemp. compound (II-1) (0.25 g/l) | Dimethylol urea (0.25 g/l) | 2.9 | A | A |
| 1-36 (Inv.) | Exemp. compound (I-47) (1 g/l) | Exemp. compound (II-1)/ Hexamethylenetetramine (0.25 g/0.25 g) | — | 3.2 | A | A |
| 1-37 (Inv.) | Exemp. compound (I-47) (1 g/l) | Exemp. compound (II-1)/ Hexamethylenetetramine (0.25 g/0.25 g) | Dimethylol urea (0.25 g/l) | 2.5 | A | A |

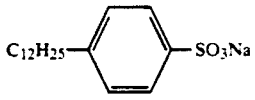

Comparative compound 1

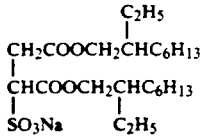

Comparative compound 2

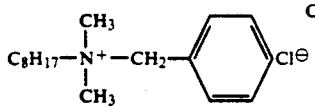

Comparative compound 3

In the above table, the degrees of stains produced on the back surfaces of the samples are indicated, respectively, by the marks, 'A' which means that no stain was found on the back surface, and 'C' which means that some stains were found. And, it means that the more the number of 'CC—', the more the stains are serious.

In the table, the degrees of stains produced on the inner wall of the stabilizing tank are indicated, respectively, by the marks, 'A' which means that no stain was found at all, 'B' which means that a few stains were found, and 'C' which means that conspicuous stains were found. And, it means that the more the number of 'CC—', the more the stains are serious.

From Table 1, it can be understood that, when the specific surfactant relating to the invention and the triazine type compound and/or the methylol type compound of the invention are used in combination, the discoloration ratio of magenta dyes and the prevention of stains inside a stabilizing tank can be made excellent without any stain on the back surface. If any one of the combination should lack, the above-mentioned objective advantages of the invention cannot be obtained. The effects of the invention is made more considerably by use of hexamethylenetetramine.

Further, when the conditions of dusts adhering to the test samples were observed at room temperature of 25° C. and a humidity of 10%, the samples of Test Nos. 1-5 to 1-15 and Nos 1-26 to 1-37 had the excellent results. The samples of Test Nos 1-5 to 1-15 and Nos 1-26 to 1-37 without any redolence of formalin at all.

Example 2

The running treatments and the evaluations were carried out in the same manner as in Test No. 1-5 of Example 1, except that magenta couplers M'-2 and M'-3 of the film sample used in Test No. 1-5 were replaced by the same mols of the magenta couplers shown in the following Table 2, provide, however, the aftermentioned magenta couplers were used therein to serve as those shown in Table 2.

The results thereof are shown in Table 2.

TABLE 2
| Test No. | Magenta coupler | Discoloration ratio (%) |
|---|---|---|
| 2-1 | M-2 | 1.3 |
| 2-2 | M-10 | 1.6 |
| 2-3 | M-18 | 1.8 |
| 2-4 | M-20 | 1.4 |
| 2-5 | M-21 | 1.2 |
| 2-6 | M-31 | 1.3 |
| 2-7 | M-37 | 1.3 |
| 2-8 | M-44 | 1.7 |
| 2-9 | M-61 | 1.6 |
| 2-10 | M-63 | 1.5 |
| 2-11 | M-68 | 1.8 |
| 2-12 | MR-4 | 6.3 |
| 2-13 | MR-5 | 5.8 |
The magenta coupler are as follows:
M-2
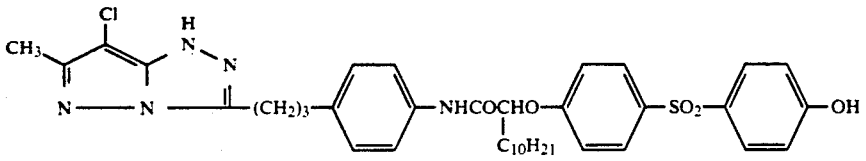
M-10
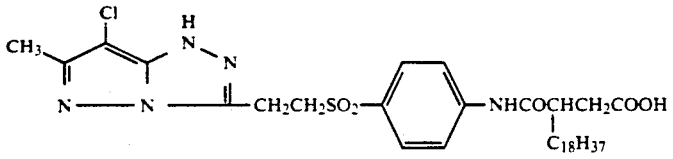
M-18
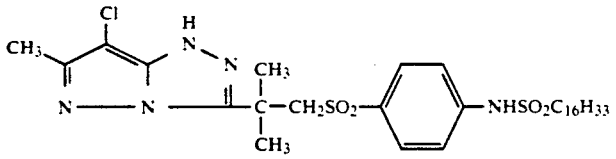
M-20
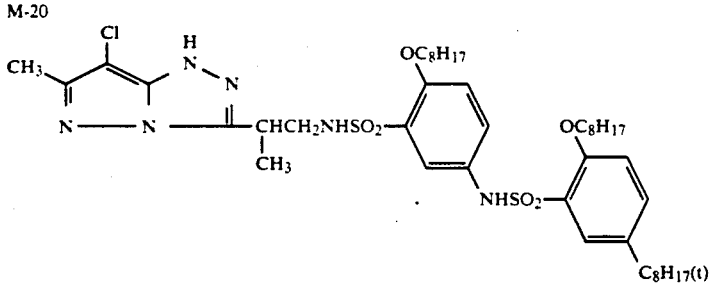
M-21
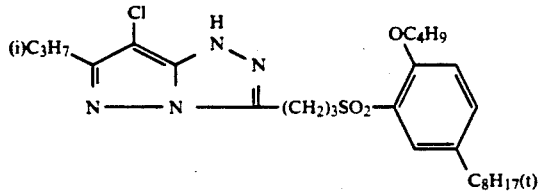
M-31
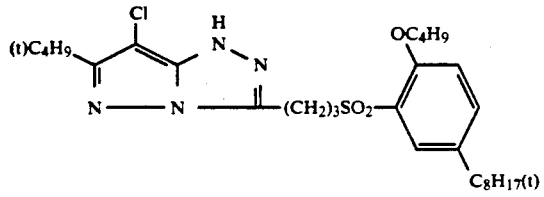

TABLE 2-continued
M-37
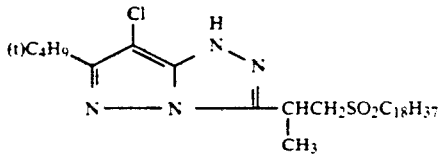
M-44
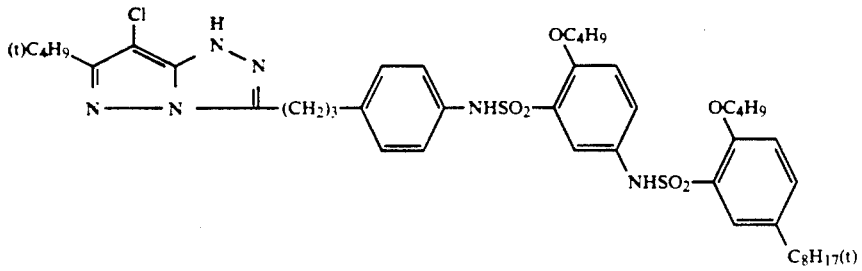
M-61
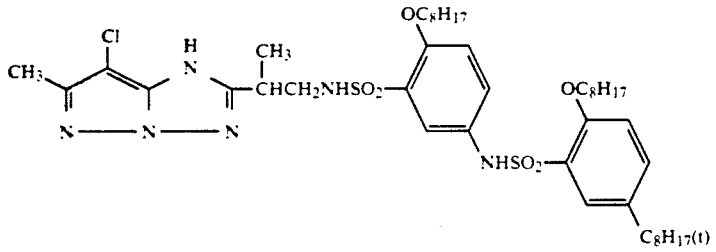
M-63
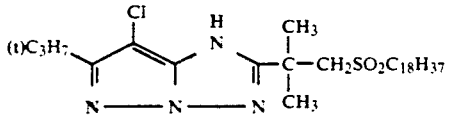
M-68
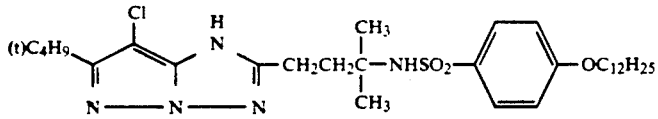
MR-4
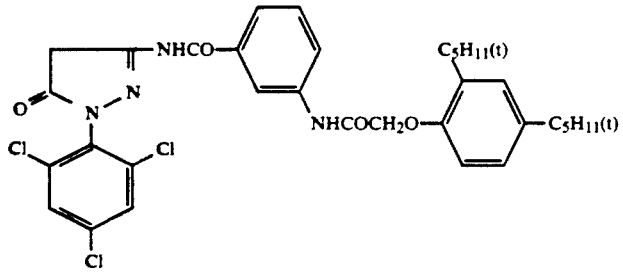
MR-5

TABLE 2-continued

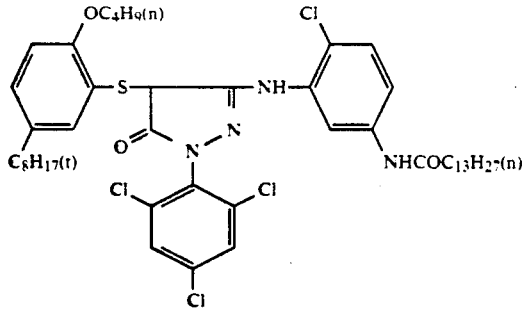

From Table 2 above, it can be understood that the objective advantages of the invention can excellently be displayed when using the pyrazoloazole type magenta couplers represented by the foregoing Formula M-1. It can also be proved that the stains on the back surfaces and the stains in the stabilizing tank were as same as in Test No. 1-5 of Example 1. The same effects of the invention are also observed in the tests with the conditions the same as Test Nos 1-26, 1-35 to 1-37 of Example I.

Example 3

The tests were tried in the same manner as in the foregoing Test No. 1-5, except that the chelating agents, i.e., disodium ethylenediaminetetraacetate, diethylenetriaminepentaacetic acid and 1-hydroxyethane-1,1-diphosphonic acid of each 1 g per liter were added into the same stabilizer as used in Example 1, respectively. As the result, it was proved that the life of the stabilizer, i.e., the number of days taken until the deposition of sulfur or silver sulfide is observed in the stabilizer, can be improved to make it about twice as long as that of Test No. 1-5, though the discoloration ratio of magenta dyes and the degrees of the stains on the back surfaces were almost equal to the results of Test No. 1-5.

Example 4

The same tests were tried as in Test No. 1-7 and No. 1-29 of Example 1, except that the antimold of the stabilizer used in Test No. 1-7 of Example 1 was replaced by Dearcide 702 manufactured by Dearborne Co., that is a mixture of 2-methyl-4-isothiazoline-3-one and 5-chloro-2-methyl-4-isothiazoline-3-one in an amount of 1 ml per liter of the stabilizer. The same results were obtained as from the foregoing tests.

Example 5

The same tests were tried as in Example 1, except that the sulfite ion releasable compounds, i.e., the fore-going exemplified compounds A-1, B-2, C-1 and A-2, were added each in an amount of 0.05 mols per liter into the same stabilizer as used in Test No. 1-5 and No. 1-36 of Example 1, respectively. The results were that the discoloration ratio of magenta dyes and the stains produced on the back surfaces were almost the same as in the foregoing tests and, in contrast, the life of the stabilizer, i.e., the number of days taken until the deposition of sulfur or silver sulfide is formed, was extended by about 50%.

Example 6

The same running tests were tried, except that the bleaching solution and the fixer used in Example 1 were replaced by the following bleach-fixer.

| [Bleach-fixer and Bleach-fixing replenisher] | |
|---|---|
| Ammonium thiosulfate | 240 g |
| Ferric ammonium diethylenediamine-pentaacetate | 150 g |
| Ammonium thiocyanate | 30 g |
| Ammonium fulfite | 15 g |
| Thiourea | 2 g |
| 2-amino-5-mercapto-1,3,4-thiadiazole | 2 g |
| Add water to make | 1 liter |
| Adjust pH with acetic acid or aqueous ammonia to be pH 7.0 | |

| Processing step | Processing time | Processing temperature | Amount* replenished |
|---|---|---|---|
| Color developing | 3 min 15 sec | 38° C. | 774 ml |
| Bleach-fixing | 3 min | 38° C. | 650 ml |
| Stabilizing | 1 min | 38° C. | 800 ml |
| Drying | 1 min | 40 to 70° C. | — |

*Amount replenished is indicated by a value per sq. meter of a light-sensitive material used.

In the tests, the stabilizing step was carried out in a triple-tank counter-current system, that is, the system in which the stabilizer was replenished to the ultimate tank and the overflow was put into the tank precedent to the ultimate tank. The other samples including film samples were tested in the same manner as in Example 1. The test results obtained were almost the same as in Example 1.

Example 7

The same running tests as in Example 1 were tried, except that the bleaching solution and the fixer used in Example 1 were replaced by the following bleaching solution and bleach-fixer.

| Bleaching solution and Bleach-fixer | |
|---|---|
| Ferric ammonium ethylenediamine-tetraacetate | 100 g |
| Ferric ammonium 1,3-propylene-diaminetetraacetate | 50 g |
| Ammonium bromide | 100 g |
| Ammonium nitrate | 45 g |
| Bleach accelerator | 0.005 mols |

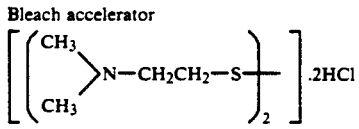

| | |
|---|---|
| Aqueous 27% ammonia | 12 ml |

-continued

| | |
|---|---|
| Acetic acid | 5 g |
| Add water to make | 1 liter |
| Adjust pH with aqueous ammonia and acetic acid to be pH 6.0 | |
| Bleach-fixer and Bleach-fixing replenisher | |
| Ferric ammonium ethylenediamine-tetraacetate | 50 g |
| Ethylenediaminetetraacetic acid | 3 g |
| Ammonium sulfite | 12 g |
| Ammonium thiosulfate | 170 g |
| Ammonium thiocyanate | 70 g |
| Aqueous 27% ammonia | 4.5 ml |
| Add water to make | 1 liter |
| Adjust pH with aqueous ammonia and acetic acid to be pH 7.2 | |

| Processing step | Processing time | Processing temperature | Amount replenished* |
|---|---|---|---|
| Color developing | 2 min 30 sec | 40° C. | 610 ml |
| Bleaching | 1 min | 38° C. | 460 ml |
| Bleach-fixing | 3 min | 38° C. | 920 ml |
| Stabilizing | 1 min | 35° C. | 800 ml |
| Drying | 1 min | 40 to 70° C. | — |

*Amount replenished is indicated by value per sq meter of a light-sensitive material used In the tests, the stabilizing step was carried out in a triple-tank counter-current system, that is, the system in which the stabilizer was replenished to the ultimate tank and the overflow was put into the tank precedent to the ultimate tank. And, a further treatments were carried out in a system in which all the overflows from a bleaching tank were flowed into a bleach-fixer tank next to the bleaching tank. The other samples including film samples were tested in the same manner as in Example 1. The test results obtained were almost the same as in example 1.

Example 8

Multilayered color photographic light-sensitive material sample 2 was prepared by forming the layers having the following compositions on a triacetyl cellulose film support, in order from the support side.

| Sample 2 | |
|---|---|
| | (g/m²) |
| Layer 1: An antihalation layer | |
| Black colloidal silver | 0.20 |
| Gelatin | 1.0 |
| CM-3 | 0.05 |
| UV-3 | 0.06 |
| UV-1 | 0.1 |
| Oil-1 | 0.10 |
| Oil-3 | 0.05 |
| Layer 2: An interlayer | |
| Gelatin | 1.0 |
| UV-3 | 0.02 |
| UV-1 | 0.01 |
| CC-2 | 0.02 |
| CF-1 | 0.005 |
| Oil-1 | 0.05 |
| Oil-2 | 0.04 |
| Layer 3: Low-speed red-sensitive emulsion layer | |
| Em-5 | 1.0 |
| Em-6 | 0.4 |
| Gelatin | 0.9 |
| S'-11 | $3.5 \times 10^{-4}$ mols/mol of Ag |
| S-2 | $5 \times 10^{-4}$ mols/mol of Ag |
| C'-5 | 0.5 |
| C'-6 | 0.04 |
| C'-1 | 0.1 |
| CC-2 | 0.1 |
| D-5 | 0.01 |

-continued

| Sample 2 | |
|---|---|
| D-1 | 0.005 |
| Oil-1 | 0.3 |
| Oil-5 | 0.2 |
| Layer 4: A high-speed red-sensitive emulsion layer | |
| Em-7 | 0.55 |
| Gelatin | 0.9 |
| S-11 | $2.5 \times 1\text{-}^{-4}$ mols/mol of Ag |
| S-2 | $3 \times 10^{-5}$ mols/mol of Ag |
| C'-7 | 0.12 |
| C'-8 | 0.06 |
| CC-2 | 0.04 |
| CC-1 | 0.01 |
| Oil-3 | 0.03 |
| Oil-5 | 0.05 |
| Oil-1 | 0.02 |
| Layer 5: An interlayer | |
| Gelatin | 0.5 |
| R-1 | 0.12 |
| Oil-3 | 0.06 |
| Layer 6: A low-speed green-sensitive emulsion layer | |
| Em-8 | 0.4 |
| Em-6 | 0.2 |
| Gelatin | 1.0 |
| S-12 | $2 \times 10^{-4}$ mols/mol of Ag |
| S-13 | $2 \times 10^{-4}$ mols/mol of Af |
| S-4 | $5 \times 10^{-4}$ mols/mol of Ag |
| M'-4 | 0.3 |
| M'-3 | 0.2 |
| Oil-3 | 0.3 |
| Oil-6 | 0.07 |
| D-4 | 0.02 |
| CM-3 | 0.05 |
| CM-4 | 0.03 |
| CM-1 | 0.01 |
| CY-1 | 0.02 |
| Layer 7: A high-speed green-sensitive emulsion layer | |
| Em-9 | 0.7 |
| Em-3 | 0.2 |
| Gelatin | 0.8 |
| S-12 | $3 \times 10^{-4}$ mols/mol of Ag |
| S-13 | $1 \times 10^{-4}$ mols/mol of Ag |
| S-4 | $5 \times 10^{-4}$ mols/mol of Ag |
| M'-4 | 0.1 |
| M'-1 | 0.1 |
| M'-2 | 0.02 |
| CM-3 | 0.02 |
| CY-1 | 0.02 |
| C'-5 | 0.02 |
| D-3 | 0.01 |
| Oil-3 | 0.4 |
| Layer 8: An interlayer | |
| Gelatin | 0.5 |
| R-1 | 0.04 |
| Oil-3 | 0.02 |
| Layer 9: A doner layer having an interlayer effect on red-sensitive layers | |
| Em-10 | 0.30 |
| Em-11 | 0.20 |
| Gelatin | 0.6 |
| S-4 | $7 \times 10^{-4}$ mols/mol of Ag |
| CY-2 | 0.10 |
| CM-5 | 0.03 |
| Oil-3 | 0.20 |
| Layer 10: A yellow filter layer | |
| Yellow colloidal silver | 0.07 |
| Gelatin | 0.7 |
| Sc-1 | 0.03 |
| R-2 | 0.07 |
| Oil-3 | 0.11 |
| Layer 11: A low-speed blue-sensitive emulsion layer | |
| Em-12 | 0.3 |
| Em-13 | 0.12 |
| Gelatin | 1.2 |
| S-10 | $4 \times 10^{-4}$ mols/mol of Ag |

-continued

| Sample 2 | |
|---|---|
| S-14 | $1 \times 10^{-4}$ mols/mol of Ag |
| C'-6 | 0.04 |
| C'-5 | 0.05 |
| CY-2 | 0.06 |
| Y-2 | 0.9 |
| Y-1 | 0.1 |
| Oil-3 | 0.2 |
| Layer 12: A high-speed blue-sensitive emulsion layer | |
| Em-14 | 0.3 |
| Gelatin | 0.6 |
| S-14 | $1 \times 10^{-4}$ mols/mol of Ag |
| S-9 | $1 \times 10^{-4}$ mols/mol of Ag |
| Y-2 | 0.12 |
| CY-2 | 0.01 |
| Y-1 | 0.2 |
| Oil-3 | 0.1 |
| Layer 13: The first protective layer | |
| Gelatin | 0.7 |
| UV-4 | 0.1 |
| UV-5 | 0.1 |
| Oil-3 | 0.01 |
| Oil-1 | 0.01 |
| HS-2 | 0.1 |
| Layer 14: The Second protective layer | |
| Em-15 | 0.4 |
| Gelatin | 0.4 |
| H-3 | 0.3 |
| Polymethyl methacrylate particles having a diameter of 1.5 μm | 0.2 |
| HS-3 | 0.4 |
| HS-4 | 0.4 |

As well as the above-given compositions, coating aid su-2, dispersion aid Su-3, antiseptics DI-1, stabilizer Stab-1, and antifoggants AF-1 and AF-2 were also added to each of the layers.

The chemical formulas and chemical structures denoted by the abbreviations of the compositions used therein are synonymous with those given in Example 1.

Em-5 :A silver iodobromide emulsion having an average grain-size of 0.55 μm, tabular-shaped grains having a diameter-to-thickness ratio of 4.0, and an average silver iodide content of 3.5 mol %

Em-6 :A silver iodobromide emulsion having an average grain-size of 0.3 μm, globular-shaped grains, and an average silver iodide content of 2.5 mol %

Em-7 :A silver iodobromide emulsion having an average grain-size of 0.72 μm, tabular-shaped grains having a diameter-to-thickness ratio of 5.0, the type of high-concentrated silver iodide contained inside the grains with a core-to-shell ratio of 1:1, and an average silver iodide content of 5.5 mol %

Em-8 :A silver iodobromide emulsion having an average grain-size of 0.5 μm, tabular-shaped grains having a diameter-to-thickness ratio of 4.0, the type of high-concentrated silver iodide contained o the grain-surfaces with a core-to-shell ratio of 1:1, and an average silver iodide content of 3.5 mol %

Em-9 :A silver iodobromide emulsion having an average grain-size of 0.72 μm, tabular-shaped grains having a diameter-to-thickness ratio of 5.0, the type of high-concentrated silver iodide contained inside the grains with a core-to-shell ratio of 1:3, and an average silver iodide content of 3.5 mol %

Em-10:A silver iodobromide emulsion having an average grain-size of 1.0 μm, tabular-shaped grains having a diameter-to-thickness ratio of 6.0, the type of high-concentrated silver iodide contained inside the grains with a core-to-shell ratio of 2:1, and an average silver iodide content of 1.7 mol %

Em-11:A silver iodobromide emulsion having an average grain-size of 0.72 μm, tabular-shaped grains having a diameter-to-thickness ratio of 5.0, the type of high-concentrated silver iodide contained inside the grains with a core-to-shell ratio of 1:3, and an average silver iodide content of 1.7 mol %

Em-12:A silver iodobromide emulsion having an average grain-size of 0.7 μm, tabular-shaped grains having a diameter-to-thickness ratio of 6.0, the type of uniformly contained silver iodide, and an average silver iodide content of 4.1 mol %

Em-13:A silver iodobromide emulsion having an average grain-size of 0.3 μm, tabular-shaped grains having a diameter-to-thickness ratio of 7.0, the type of uniformly contained silver iodide, and an average silver iodide content of 2.5 mol %

Em-14:A silver iodobromide emulsion having an average grain-size of 1.1 μm, multiple twin-crystal tabular-shaped grains, the type of high-concentrated silver iodide contained inside the grains, and an average silver iodide content of 8.0 mol %

Em-15:A finely grained silver iodobromide emulsion having an average grain-size of 0.07 μm, the type of uniformly contained silver iodide, and an average silver iodide content of 1.8 mol %

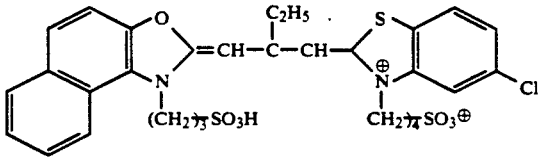

S-11

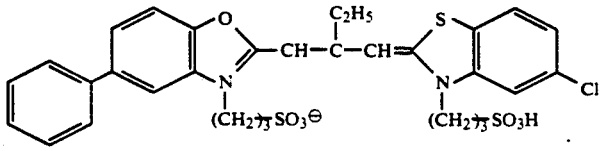

S-12

-continued
S-13
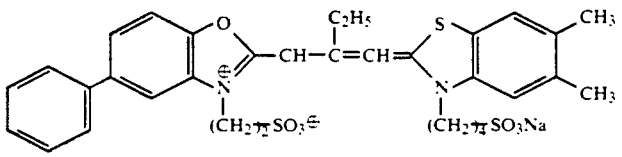
S-14
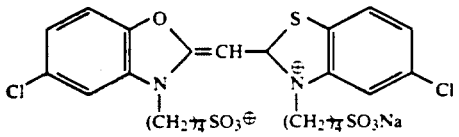
C'-6
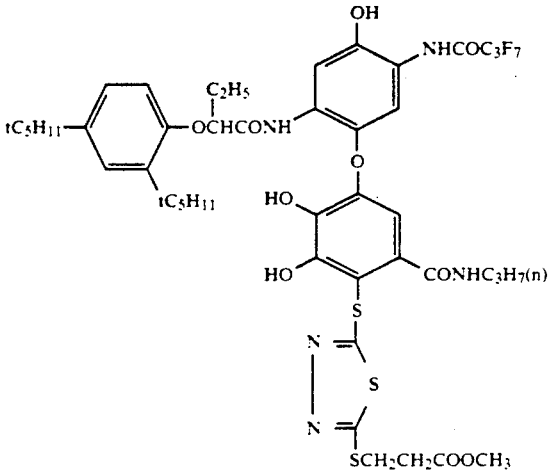
C'-7
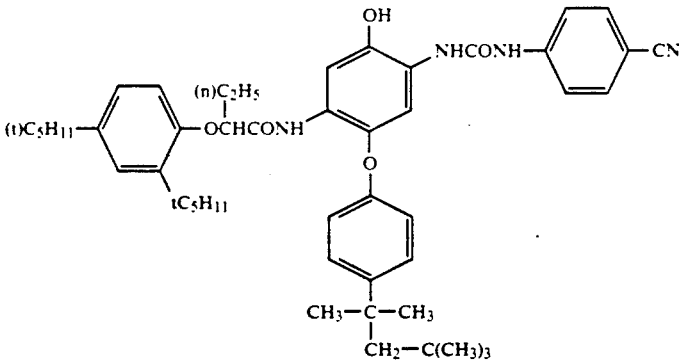
C'-8
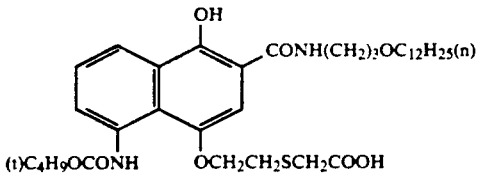
C'-5
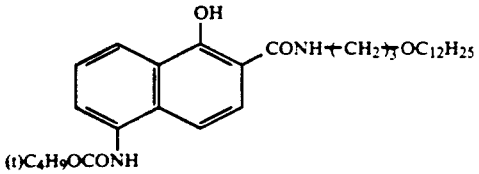

-continued
M'-4
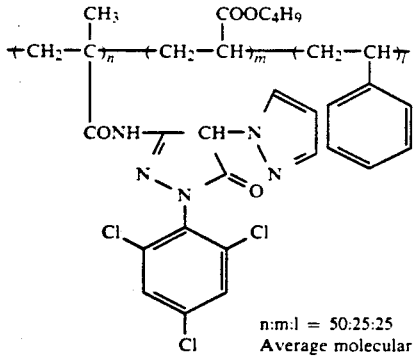
n:m:l = 50:25:25
Average molecular weight: 2000 approx.
CM-3
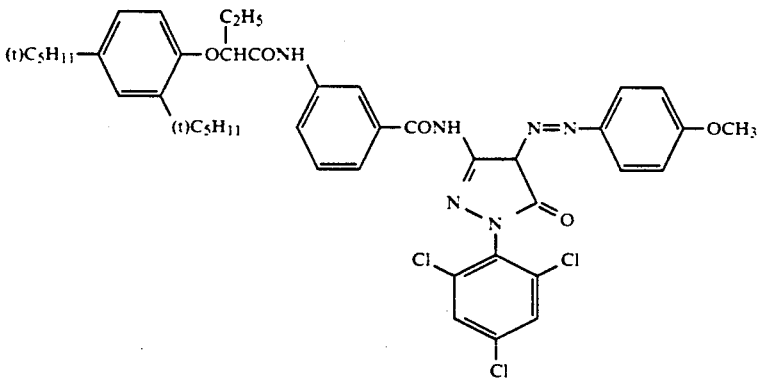
CM-4
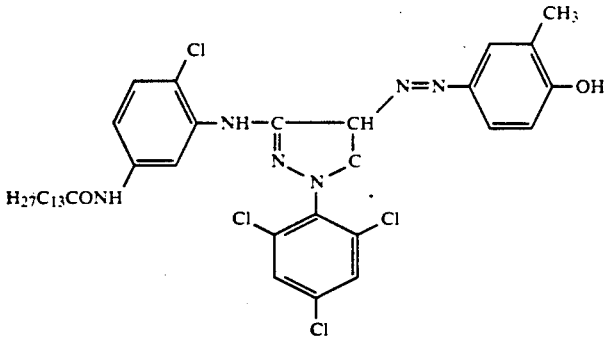
CM-5
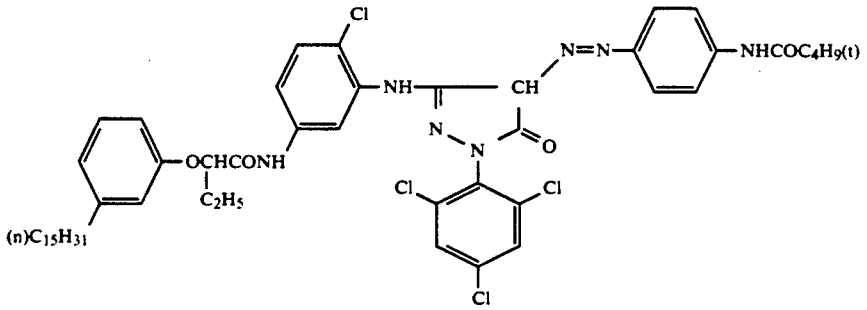

-continued
CM-6
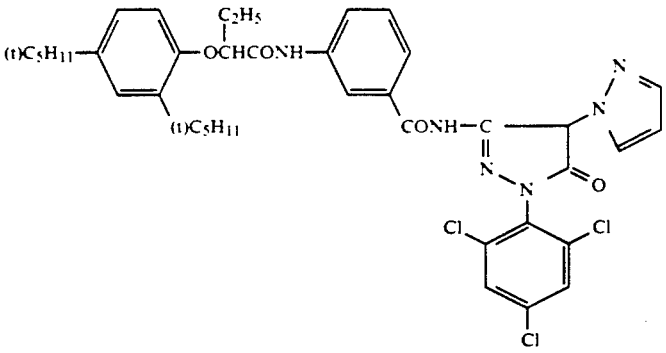
CY-1
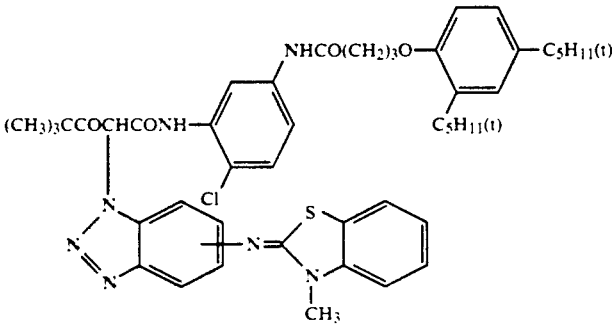
CY-2
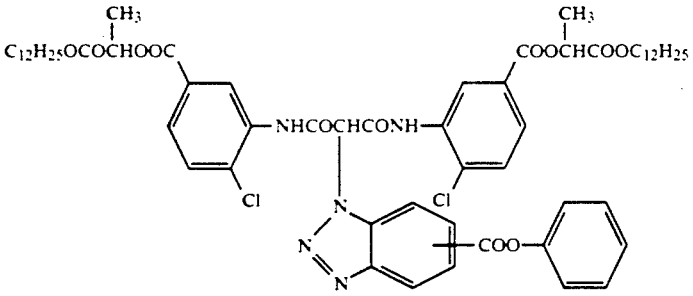
CC-2
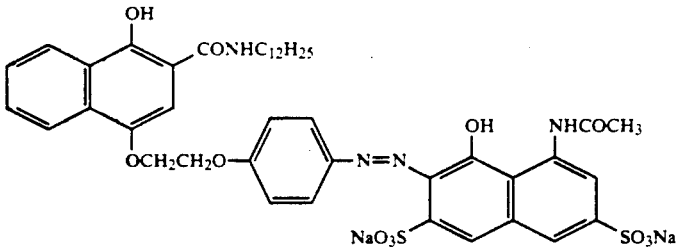
CF-1
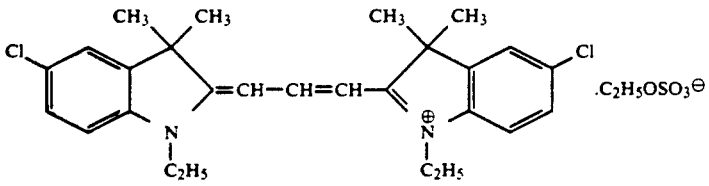
H-1
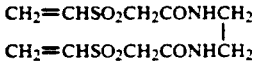

-continued
R-1
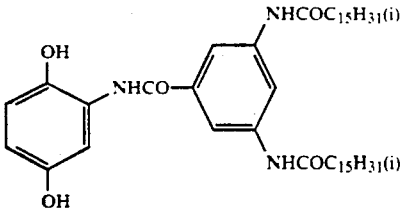
R-2
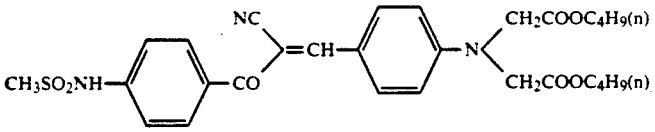
Oil-6
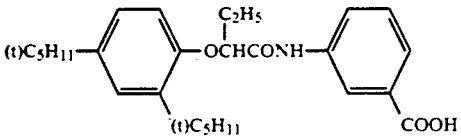
D-5
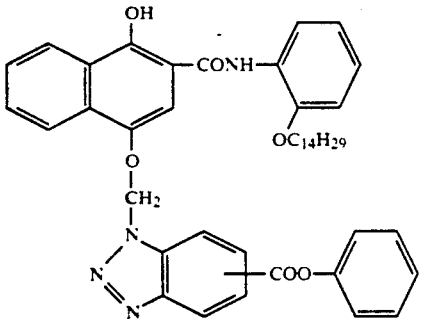
UV-3
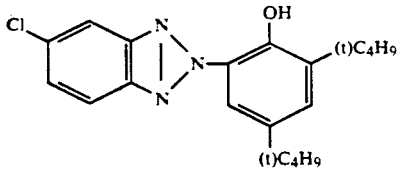
UV-4
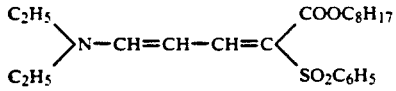
UV-5
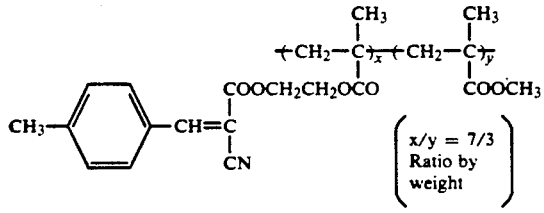
HS-3
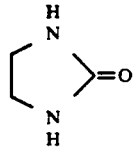

-continued

HS-4

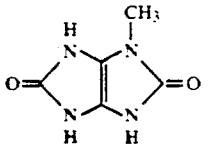

The films, Sample 2, thus prepared were sensitometrically exposed to light and then processed in the processing steps and under the conditions given below.

| Processing step | Processing time | Processing temperature | Amount* replenished |
|---|---|---|---|
| Color developing | 60 sec | 50° C. | 600 ml |
| Bleaching | 30 sec | 50° C. | 310 ml |
| Fixing | 45 sec | 50° C. | 1000 ml |
| Stabilizing | 45 sec | 50° C. | 1000 ml |
| Drying | 30 sec | 60 to 80° C. | — |

*Amount replenished is indicated by a value per sq. meter of a light-sensitive material used.

In the process, however, the stabilizing step was carried out in a three-tank counter-current system. Each of the processing solutions used were the same as in Example 1.

When trying the same running tests as in example 1, the almost same results were obtained.

Example 9

The following blecher, bleacher replenisher, fixer and fixer replenisher were prepared, respectively.

| The composition of the bleacher used was as follows: | |
|---|---|
| Ferric potassium 1,3-propylenediamine-tetraacetate | 0.32 mols |
| Disodium ethylenediaminetetraacetate | 10 g |
| Potassium bromide | 100 g |
| Maleic acid | 30 g |
| Sodium nitrate | 40 g |
| Add water to make | 1 liter |
| Adjust pH to be | pH 4.4 |
| The composition of the bleacher replenisher used was as follows: | |
| Ferric potassium 1,3-propylenediamine-tetraacetate | 0.35 mols |
| Disodium ethylenediaminetetraacetate | 2 g |
| Potassium bromide | 120 g |
| Sodium nitrate | 50 g |
| Maleic acid | 40 g |
| Add water to make | 1 liter |
| Adjust pH to be | pH 3.4 |
| The composition of the fixer and fixer replenisher used were as follows: | |
| Potassium thiocyanate | 120 g |
| Potassium thiosulfate | 200 g |
| Sodium bisulfite, anhydrous | 20 g |
| Sodium metabisulfite | 4.0 g |
| Disodium ethylenediaminetetraacetate | 1.0 g |
| Add water to make | 1 liter |
| Adjust pH to be | pH 6.5 |

The stabilizers and stabilizer replenishers used therein were the same as those of Experiment Nos. 1-1 to I-4, I-5 to I-12, I-29, and I-35 to I-37. When evaluating the results in the same manner as in Example 1, almost the same effects as in Example 1 were obtained and, in addition, the excellent surrounding conditions could be kept without any odor of ammonia or acetic acid. Further, separately from the effects of the invention obtained, the bleach-fog, i.e., the transmission densities of B,G,R, was lowered by the order of 0.01 ~ 0.03 and the desilvering property was also excellent, because ammonia and acetic acid were made free.

Example 10

In the same silver halide color photographic light-sensitive material used in Example 1, the antihalation layer that was the first layer thereof was added by the following compounds each in an amount of 0.015 g per sq.meter of the light-sensitive material. When the same evaluation was tried as in Example 6, the effects were found on the desilvering property and color-fading ratio and the same results as in Example 6 were obtained.

$AgSC_2H_4COOH$ BAG-1

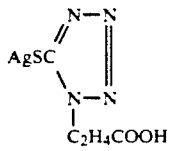

BAG-2

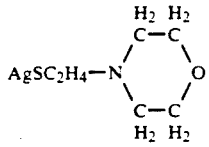

BAG-3

Example 11

In Examples 1, 6 and 7, each of the cross-over time was set to be 5 seconds between the stabilizing tank and the preceding tank that is the fixing tank or bleach-fixing tank. After processed the samples through the processor shown in FIG. 1, the stains on both of the rear side and inner-wall of the stabilizing tank and the color-fading ratio were evaluated. The results were that the stains on both of the rear side and inner-wall of the stabilizing tank were improved in Examples 1, 6 and 7, although the colorfading ratio was not so varied.

What is claimed is:

1. A stabilizing solution for processing a silver halide photographic light-sensitive material comprising a compound selected from the group consisting of water-soluble siloxane compounds each having a polyoxyalkylene group, said compound represented by the following formulas I or II, in an amount of 0.05 g to 40 g per liter; and, a triazine type compound represented by the following formula III in an amount of from 0.1 g to 20 g per liter;

$$A_2—O—(A)l—(B)m—(C)n—X_1 \quad (I)$$

wherein $A_2$ is a monovalent organic group; A, B and C are each an ethyleneoxy group, propyleneoxy group or a $$-(CH_2)n_1-\underset{\underset{OH}{|}}{(CH)}m_1-(CH_2)l_1-O- \text{ group.}$$

in which $m_1$ is an integer of 1, 2 or 3, and $n_1$ and $l_1$ are each an integer of 0, 1, 2 or 3; $X_1$ is a hydrogen atom, a $-SO_3M$ group, a $-PO_3M_2$ group, an alkyl group, an aralkyl group or an aryl group, in which M is a hydrogen atom, an alkali metal atom or an ammonium group; and l, m and n are each an integer of zero to 100 provided that the total of l, m and n is not less than 2;

$$R^1-X^2-(E^1)l_2-(E^2)m_2-(E^3)n_2-R^2 \quad \text{(II)}$$

wherein $R^1$ is a hydrogen atom, an aliphatic group or an acyl group; $R^2$ is a hydrogen atom or an aliphatic group; $E^1$, $E^2$ and $E^3$ are each an ethyleneoxy group or a propyleneoxy group; $X^2$ is an oxygen to or an $$-\underset{\underset{R^3}{|}}{N}- \text{ group.}$$

in which $R^3$ is a hydrogen atom, an aliphatic group or an $-(E^1)l_3-(E^2)m_3-(E^3)n_3-R^4$ group, in which $R^4$ is a hydrogen atom or an aliphatic group; and $l_2$, $l_3$, $m_2$, $m_3$, $n_2$ and $n_3$ are each an integer of from zero to 200 provided that the total of $l_2$, $m_2$ and $n_2$, and that of $l_3$, $m_3$ and $n_3$ are each not less than 2;

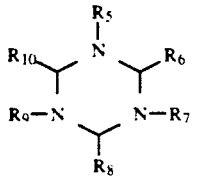

(III)

wherein $R^5$, $R^6$, $R^7$, $R^8$, $R^9$, and $R^{10}$ are each a hydrogen atom or a monovalent organic group.

2. The stabilizing solution of claim 1, wherein said siloxane compound is a compound represented by the following formula VII $$\begin{array}{l} CH_3-\underset{\underset{CH_3}{|}}{\overset{\overset{CH_3}{|}}{Si}}-O-(\underset{\underset{CH_3}{|}}{\overset{\overset{CH_3}{|}}{Si}}O)l_4-(\underset{\underset{(CH_2)p-(OC_2H_4)q_1-(OC_3H_6)q_2-R_{11}}{|}}{\overset{\overset{CH_3}{|}}{Si}}-O)l_5-(\underset{\underset{CH_3}{|}}{\overset{\overset{CH_3}{|}}{Si}})l_6-CH_3 \end{array} \quad \text{(VII)}$$

wherein $R_{11}$ is a hydrogen atom, a hydroxy group, a lower alkyl group, an alkoxy group $$a\ -\underset{\underset{R_{14}}{|}}{\overset{\overset{R_{12}}{|}}{Si}}-R_{13} \text{ group or a } -O-\underset{\underset{R_{14}}{|}}{\overset{\overset{R_{12}}{|}}{Si}}-R_{13} \text{ group,}$$

in which $R_{12}$, $R_{13}$ and $R_{14}$ are each a lower alkyl group; $l_4$, $l_5$ and $l_6$ are each an integer of 0, 1, 2, 3 or 4 provided that the $l_4$, $l_5$ and $l_6$ are not 0 at the same time; and p, $q_1$ and $q_2$ are each an integer of 1 to 15.

3. The stabilizing solution of claim 1, wherein said compound represented by formula I or formula II is contained in said stabilizing solution in an amount of from 0.1 g to 20 g per liter.

4. A method for processing a silver halide photographic light-sensitive material comprising the following steps:

a) treating a silver halide photographic light-sensitive material with a solution capable of fixing a silver halide photographic light-sensitive material; and b) following said treating step, further treating said silver halide photographic light-sensitive material with a stabilizing solution comprising:

i) a compound selected from the group consisting of water-soluble siloxane compounds each having a polyoxyalkylene group, said compound represented by the following formulas I or II, in an amount of 0.05 g to 40 g per liter; and, ii) a triazine type compound represented by the following formula III in an amount of from 0.1 g to 20 g per liter;

$$A_2-O-(A)l-(B)m-(C)n-X_1 \quad \text{(I)}$$

wherein $A_2$ is a monovalent organic group; A, B and C are each an ethyleneoxy group, propyleneoxy group or a $$-(CH_2)n_1-\underset{\underset{OH}{|}}{(CH)}m_1-(CH_2)l_1-O- \text{ group.}$$

in which $m_1$ is an integer of 1, 2 or 3, and $n_1$ and $l_1$ are each an integer of 0, 1, 2 or 3; $X_1$ is a hydrogen atom, a $-SO_3M$ group, a $-PO_3M_2$ group, an alkyl group, an aralkyl group or an aryl group, in which M is a hydrogen atom, an alkali metal atom or an ammonium group; and l, m and n are each an integer of zero to 100 provided that the total of l, m and n is not less than 2;

$$R^1-X^2-(E^1)l_2-(E^2)m_2-(E^3)n_2-R^2 \quad \text{(II)}$$

wherein $R^1$ is a hydrogen atom, an aliphatic group or an acyl group; $R^2$ is a hydrogen atom or an aliphatic group; $E^1$, $E^2$ and $E^3$ are each an ethyleneoxy group or a propyleneoxy group; $X^2$ is an oxygen atom or an $$-\underset{\underset{R^3}{|}}{N}- \text{ group,}$$

in which $R^3$ is a hydrogen atom, an aliphatic group or an $-(E^1)l_3-(E^2)m_3-(E^3)n_3-R^4$ group, in which $R^4$ is a hydrogen atom or an aliphatic group; and $l_2$, $l_3$, $m_2$, $m_3$, $n_2$ and $n_3$ are each an integer of from zero to 200 provided that the total of $l_2$, $m_2$ and $n_2$, and that of $l_3$, $m_3$ and $n_3$ are each not less than 2;

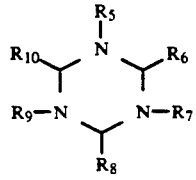

(III)

wherein $R_5$, $R_6$, $R_7$, $R_8$, $R_9$, and $R_{10}$ are each a hydrogen atom or a monovalent organic group;

provided that said light-sensitive material is not substantially washed between said two treating steps.

5. The method of claim 4, wherein said siloxane compound is a compound represented by the following formula VII:

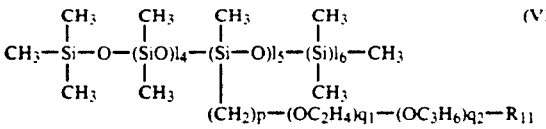

(VII)

wherein $R_{11}$ is a hydrogen atom, a hydroxy group, a lower alkyl group, an alkoxy group

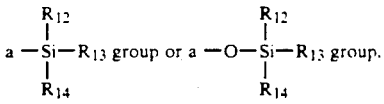

in which $R_{12}$, $R_{13}$ and $R_{14}$ are each a lower alkyl group; $l_4$, $l_5$ and $l_6$ are each an integer of 0, 1, 2, 3 or 4 provided that the $l_4$, $l_5$ and $l_6$ are not 0 at the same time; and p, $q_1$ and $q_2$ are each an integer of 1 to 15.

6. The method of claim 4, wherein said compound represented by formula I or formula II is contained in said stabilizing solution in an amount of from 0.1 g to 20 g per liter.

* * * * *